US005829252A

United States Patent [19]

Hirata et al.

[11] Patent Number: 5,829,252

[45] Date of Patent: Nov. 3, 1998

[54] HYDRAULIC SYSTEM HAVING TANDEM HYDRAULIC FUNCTION

[75] Inventors: Toichi Hirata, Ushiku; Genroku Sugiyama; Tsukasa Toyooka, both of Ibaraki-ken, all of Japan

[73] Assignee: Hitachi Construction Machinery, Co., Ltd., Tokyo, Japan

[21] Appl. No.: 836,664

[22] PCT Filed: Sep. 17, 1996

[86] PCT No.: PCT/JP96/02660

§ 371 Date: May 16, 1997

§ 102(e) Date: May 16, 1997

[87] PCT Pub. No.: WO97/11278

PCT Pub. Date: Mar. 27, 1997

[30] Foreign Application Priority Data

Sep. 18, 1995 [JP] Japan ..... 7-238804

[51] Int. Cl.[6] ..... F16D 31/02

[52] U.S. Cl. ..... 60/421; 60/422; 60/429; 60/430

[58] Field of Search ..... 60/422, 484, 486, 60/430, 421, 428, 429; 91/445

[56] References Cited

U.S. PATENT DOCUMENTS

| | | | |
|---|---|---|---|
| 3,991,571 | 11/1976 | Johnson | 60/422 |
| 4,136,600 | 1/1979 | Heiser | 91/445 |
| 4,517,800 | 5/1985 | Karakama | 60/422 |
| 5,048,293 | 9/1991 | Aoyagi | 60/428 |
| 5,148,676 | 9/1992 | Moriya et al. | 60/422 |

FOREIGN PATENT DOCUMENTS

| | | |
|---|---|---|
| 59-61198 | 4/1984 | Japan . |
| 2-16416 | 4/1990 | Japan . |
| 2-140332 | 5/1990 | Japan . |
| 4-52329 | 2/1992 | Japan . |
| 4-194405 | 7/1992 | Japan . |

*Primary Examiner*—Edward K. Look
*Assistant Examiner*—Bijan N. Karimi
*Attorney, Agent, or Firm*—Fay, Sharpe, Beall, Fagan, Minnich & McKee

[57] ABSTRACT

Pump ports 9*p*, 10*p*, 11*p*, 13*p* of boom, arm, bucket and first travel directional control valves 9–11, 13 are connected to first and second hydraulic pumps 1*a*, 1*b* through feeder lines 93*a*, 93*b*; 103*a*, 103*b*; 113*a*, 113*b*; 133*a*, 133*b*. Auxiliary valves 91*a*, 91*b*; 101*a*, 101*b*; 111*a*, 101*b*; 131*a*, 131*b* controlled respectively by proportional solenoid valves 31*a*, 31*b*; 32*a*, 32*b*; 33*a*, 33*b*; 34*a*, 34*b* are disposed in those feeder lines. The auxiliary valves each have a function as a reverse-flow preventing function and a variable resisting function including a flow cutoff function, whereby a joining circuit and a preference circuit can be realized in the closed center circuit with a simple structure and further, a preference degree and metering characteristics can be set independently of each other during the combined operation of plural actuators.

23 Claims, 30 Drawing Sheets

FIG.17

| | | | BOOM | | ARM | | BUCKET | | TRAVEL | |
|---|---|---|---|---|---|---|---|---|---|---|
| | | | 91a | 91b | 101a | 101b | 111a | 111b | 131a | 131b |
| SOLE OPE-RATI-ON | TRAVEL | | (△) | (○) | (△) | (○) | (△) | (○) | × | ○ |
| | SWING | | (○) | (○) | (○) | (△) | (○) | (△) | (○) | (△) |
| | BOOM | UP | ○ | ○ | (△) | (○) | (△) | (△) | (○) | (△) |
| | | DOWN | ○ | × | (△) | (○) | (○) | (△) | (○) | (△) |
| | ARM | CROWDING | (○) | (○) | ○ | ○ | (○) | (△) | (○) | (△) |
| | | DUMPING | (○) | (○) | ○ | ○ | (○) | (△) | (○) | (△) |
| | BUC-KET | CROWDING | (○) | (○) | (△) | (○) | ○ | ○ | (○) | (△) |
| | | DUMPING | (○) | (○) | (△) | (○) | ○ | × | (○) | (△) |

○ FULLY OPENED
× FULLY CLOSED
△ THROTTLED (DEPENDING ON OPERATION AMOUNT OF COUNTERPART)

FIG.18

NOT FULLY CLOSED

| | | | BOOM | | ARM | | BUCKET | | TRAVEL | |
|---|---|---|---|---|---|---|---|---|---|---|
| | | | 91a | 91b | 101a | 101b | 111a | 111b | 131a | 131b |
| COMBINED OPERATION OF TWO MEMBERS INCLUDING TRAVEL | BOOM | UP | △ | ○ | (△) | (○) | (△) | (△) | ○ | △ |
| | | DOWN | △ | ○ | (△) | (○) | (○) | (△) | ○ | △ |
| | ARM | CROWDING | (△) | (×) | △ | ○ | (△) | (△) | ○ | △ |
| | | DUMPING | (△) | (×) | △ | ○ | (△) | (△) | ○ | △ |
| | BUC-KET | CROWDING | (△) | (×) | (△) | (○) | △ | ○ | ○ | △ |
| | | DUMPING | (△) | (×) | (△) | (○) | △ | ○ | ○ | △ |
| | SWING | | (△) | (○) | (△) | (△) | (△) | (△) | ○ | △ |
| COMBINED OPERATION OF THREE MEMBERS INCLUDING TRAVEL | BOOM -UP | ARM CROWDING | △ | ○ | △ | ○ | (△) | (△) | ○ | △ |
| | | ARM DUMPING | △ | ○ | △ | ○ | (△) | (△) | ○ | △ |
| | BOOM -DOWN | ARM CROWDING | △ | × | △ | ○ | (△) | (△) | ○ | △ |
| | | ARM DUMPING | △ | × | △ | ○ | (△) | (△) | ○ | △ |

○ FULLY OPENED
× FULLY CLOSED
△ THROTTLED (DEPENDING ON OPERATION AMOUNT OF COUNTERPART)

FIG.19

| | | | BOOM | | ARM | | BUCKET | | TRAVEL | |
|---|---|---|---|---|---|---|---|---|---|---|
| | | | 91a | 91b | 101a | 101b | 111a | 111b | 131a | 131b |
| COMBINED OPERATION OF TWO MEMBERS INCLUDING SWING | BOOM | UP | ○ | ○ | (△) | (○) | (○) | (△) | (○) | (△) |
| | | DOWN | ○ | × | (△) | (○) | (○) | (△) | (○) | (△) |
| | ARM | CROWDING | (○) | (○) | ○ | △ | (○) | (△) | (○) | (△) |
| | | DUMPING | (○) | (○) | ○ | △ | (○) | (△) | (○) | (△) |
| | BUC-KET | CROWDING | (○) | (○) | (△) | (○) | ○ | △ | (○) | (△) |
| | | DUMPING | (○) | (○) | (△) | (○) | ○ | △ | (○) | (△) |
| COMBINED OPERATION OF THREE MEMBERS INCLUDING SWING | BOOM -UP | ARM CROUDING | ○ | ○ | △ | ○ | (△) | (△) | (○) | (△) |
| | | ARM DUMPING | ○ | ○ | △ | ○ | (△) | (△) | (○) | (△) |
| | BOOM -DOWN | ARM CROUDING | ○ | × | △ | ○ | (△) | (△) | (○) | (△) |
| | | ARM DUMPING | ○ | × | △ | ○ | (△) | (△) | (○) | (△) |

○ FULLY OPENED
× FULLY CLOSED
△ THROTTLED (DEPENDING ON OPERATION AMOUNT OF COUNTERPART)

FIG.20

| | | | BOOM | | ARM | | BUCKET | | TRAVEL | |
|---|---|---|---|---|---|---|---|---|---|---|
| | | | 91a | 91b | 101a | 101b | 111a | 111b | 131a | 131b |
| COMBINED OPERATION OF TWO MEMBERS OF FRONT WORKING EQUIPMENT | BOOM -UP | ARM CROWDING | ○ | ○ | △ | ○ | (○) | (△) | (○) | (△) |
| | | ARM DUMPING | ○ | ○ | △ | ○ | (○) | (△) | (○) | (△) |
| | | BUCKET CROWDING | ○ | ○ | (△) | (○) | ○ | ○ | (○) | (△) |
| | | BUCKET DUMPING | ○ | ○ | (△) | (○) | ○ | ○ | (○) | (△) |
| | BOOM -DOWN | ARM CROWDING | ○ | × | △ | ○ | (△) | (△) | (○) | (△) |
| | | ARM DUMPING | ○ | × | △ | ○ | (△) | (△) | (○) | (△) |
| | | BUCKET CROWDING | ○ | × | (△) | (○) | ○ | ○ | (○) | (△) |
| | | BUCKET DUMPING | △ | × | (△) | (○) | ○ | ○ | (○) | (△) |
| | ARM CROWDING | BUCKET CROWDING | (○) | (×) | △ | ○ | ○ | ○ | (○) | (△) |
| | | BUCKET DUMPING | (○) | (×) | △ | ○ | ○ | ○ | (○) | (△) |
| | ARM DUMPING | BUCKET CROWDING | (○) | (×) | △ | ○ | ○ | ○ | (○) | (△) |
| | | BUCKET DUMPING | (○) | (×) | △ | ○ | ○ | ○ | (○) | (△) |

○ FULLY OPENED
× FULLY CLOSED
△ THROTTLED (DEPENDING ON OPERATION AMOUNT OF COUNTERPART)

FIG.21

| | | | | BOOM | | ARM | | BUCKET | | TRAVEL | |
|---|---|---|---|---|---|---|---|---|---|---|---|
| | | | | 91a | 91b | 101a | 101b | 111a | 111b | 131a | 131b |
| COMBINED OPERATION OF THREE MEMBERS OF FRONT WORKING EQUIPMENT | BOOM -UP | ARM CROWDING | BUCKET CROWDING | ○ | ○ | △ | ○ | △ | × | (○) | (△) |
| | | | BUCKET DUMPING | ○ | ○ | △ | ○ | △ | × | (○) | (△) |
| | | ARM DUMPING | BUCKET CROWDING | ○ | ○ | △ | ○ | △ | × | (○) | (△) |
| | | | BUCKET DUMPING | ○ | ○ | △ | ○ | △ | × | (○) | (△) |
| | BOOM -DOWN | ARM CROEDING | BUCKET CROWDING | ○ | × | △ | ○ | ○ | × | (○) | (△) |
| | | | BUCKET DUMPING | ○ | × | △ | ○ | ○ | × | (○) | (△) |
| | | ARM DUMPING | BUCKET CROWDING | ○ | × | △ | ○ | ○ | × | (○) | (△) |
| | | | BUCKET DUMPING | ○ | × | △ | ○ | ○ | × | (○) | (△) |

○ FULLY OPENED
× FULLY CLOSED
△ THROTTLED (DEPENDING ON OPERATION AMOUNT OF COUNTERPART)

CONVENTIONAL OPEN CENTER CIRCUIT

HYDRAULIC SYSTEM HAVING TANDEM HYDRAULIC FUNCTION

TECHNICAL FIELD

The present invention relates to a hydraulic system for driving a plurality of actuators by a plurality of pumps in a hydraulic excavator or the like.

BACKGROUND ART

Hydraulic systems for driving a plurality of actuators by a plurality of pumps comprise so-called open center circuits as disclosed in JP-B-2-16416, for example, and so-called closed center circuits as disclosed in JP-A-4-194405. The open center circuit is a circuit having a center bypass line, and a pump delivery flow is bled to a reservoir through the center bypass line when each directional control valve is in a neutral condition. An opening of the center bypass line located in each directional control valve is gradually throttled as the directional control valve is shifted by a larger amount, whereupon a pump pressure is produced and a hydraulic fluid is supplied to each corresponding actuator through a meter-in circuit.

In the open center circuit, independence of plural actuators is maintained by providing a preference circuit in the form of a so-called tandem connection or arranging a plurality of hydraulic pumps so that hydraulic fluids are joined together selectively.

On the other hand, the closed center circuit is a circuit having no center bypass line. As disclosed in the above-cited JP-A-4-194405, spools are connected to a hydraulic pump in parallel. There are also known a load sensing system for controlling a differential pressure between a pump pressure and a load pressure to be fixed when each directional control valve is in a neutral condition, and a system for reducing a pump delivery rate through a bleed circuit including a bleed valve as disclosed in JP-A-7-63203 when each directional control valve is in a neutral position.

DISCLOSURE OF THE INVENTION

In the open center circuit, as mentioned above, independence of plural actuators is maintained by providing a preference circuit in the form of a so-called tandem connection or by arranging a plurality of hydraulic pumps so that hydraulic fluids are joined together selectively. However, it is required not only to form a center bypass line in each directional control valve, but also to provide a plurality of directional control valves for one actuator. The valve structure is, therefore, complicated and increased in size. Also, because the preference circuit is made up by using the center bypass line, a preference degree and metering characteristics cannot be set independently of each other during the combined operation of actuators.

In the closed center circuit, the valve structure is relatively simple because the center bypass line is not necessary and only one directional control valve is usually required for one actuator. However, the closed center circuit is basically a parallel circuit and hence has a difficulty in realizing a preference circuit.

A first object of the present invention is to provide a hydraulic system in which a joining circuit and a preference circuit are realized in a closed center circuit with a simple structure.

A second object of the present invention is to provide a hydraulic system in which a preference degree and metering characteristics can be set independently of each other during the combined operation of actuators in a closed center circuit.

(1) To achieve the above first object, the present invention is constituted as follows. A hydraulic system comprises first and second hydraulic pumps, first and second actuators, a first directional control valve of closed center type connected to the first and second hydraulic pumps for controlling a flow rate of a hydraulic fluid supplied to the first actuator, and a second directional control valve of closed center type connected to at least the first hydraulic pump for controlling a flow rate of a hydraulic fluid supplied. The second actuator, the hydraulic system further comprises first and second feeder lines respectively connecting the first and second hydraulic pumps to a pump port of the first directional control valve, and first and second reverse-flow preventing valves disposed respectively in the first and second feeder lines for preventing the hydraulic fluids from reversely flowing to the first and second hydraulic pumps.

In the present invention constructed as set forth above, when the first actuator is solely driven, the hydraulic fluids from the first and second hydraulic pumps are joined together through the first and second feeder lines (joining circuit). Also, the first and second reverse-flow preventing valves serve to prevent the hydraulic fluids from reversely flowing to the pumps from the actuator when the load pressure of the first actuator is higher than the delivery pressures of the first and second hydraulic pumps (load check valves).

When the first and second actuators are both simultaneously driven, it is always ensured in a hydraulic system where the load pressure of the first actuator is higher than the load pressure of the second actuator that the first actuator can be operated by the hydraulic fluid from the second hydraulic pump and the second actuator can be operated by the hydraulic fluid from the first hydraulic pump. At this time, even with the load pressure of the second actuator being lower than the load pressure of the first actuator, the hydraulic fluid from the second hydraulic pump is prevented from flowing into the second actuator by the presence of the first reverse-flow preventing valve (preference circuit).

(2) In the above (1), preferably, a first auxiliary valve with a flow cutoff function of selectively cutting off a flow of the hydraulic fluid supplied from the first hydraulic pump is disposed, in addition to the first reverse-flow preventing valve, in at least the first feeder line of the first and second feeder lines.

When the first actuator is solely driven, the hydraulic fluids from the first and second pumps can be joined together and supplied to the first actuator through the first and second feeder lines, as with the above case, by holding the flow cutoff function of the first auxiliary valve turned off (joining circuit).

When the first and second actuators are both simultaneously driven, the flow cutoff function of the first auxiliary valve is turned on upon detecting an operation of the second directional control valve, causing the first hydraulic pump to be connected to the second actuator preferentially (i.e., in tandem). Regardless of the load pressures of the first and second actuators, therefore, the first actuator can be operated by the hydraulic fluid from the second hydraulic pump and the second actuator can be operated by the hydraulic fluid from the first pump independently of each other (preference circuit).

(3) In the hydraulic system of the above (1) wherein the second directional control valve is connected to the first and second hydraulic pumps, preferably, the hydraulic system further comprises third and fourth feeder lines respectively connecting the first and second hydraulic pumps to a pump port of the second directional control valve, and third and fourth reverse-flow preventing valves disposed respectively in the third and fourth feeder lines for preventing the hydraulic fluids from reversely flowing to the first and second hydraulic pumps, wherein a first auxiliary valve with a flow cutoff function of selectively cutting off a flow of the hydraulic fluid supplied from the first hydraulic pump is disposed, in addition to the first reverse-flow preventing valve, in at least the first feeder line of the first and second feeder lines, and a fourth auxiliary valve with a flow cutoff function of selectively cutting off a flow of the hydraulic fluid supplied from the second hydraulic pump is disposed, in addition to the fourth reverse-flow preventing valve, in at least the fourth feeder line of the third and fourth feeder lines.

When the first actuator is solely driven, the hydraulic fluids from the first and second hydraulic pumps can be joined together and supplied to the first actuator, as with the above case, by holding the flow cutoff function of the first auxiliary valve turned off (joining circuit).

When the second actuator is solely driven, the hydraulic fluids from the first and second hydraulic pumps can be joined together and supplied to the second actuator, as with the above case, by holding the flow cutoff function of the fourth auxiliary valve turned off (joining circuit).

When the first and second actuators are both simultaneously driven, the flow cutoff functions of the first and fourth auxiliary valves are turned on upon detecting operations of the first and second directional control valves, respectively, causing the first hydraulic pump to be connected to the second actuator preferentially and the second hydraulic pump to be connected to the first actuator preferentially. Regardless of the load pressures of the first and second actuators, therefore, the first actuator can be operated by the hydraulic fluid from the second hydraulic pump and the second actuator can be operated by the hydraulic fluid from the first hydraulic pump independently of each other (preference circuit).

(4) In the above (3), preferably, each of the first and fourth auxiliary valves is constructed to further have a variable resisting function including said flow cutoff function.

(5) In the above (4) having such a feature, preferably, the variable resisting function of the first auxiliary valve increases line resistance depending on an operation amount of the second directional control valve, and the variable resisting function of the fourth auxiliary valve increases line resistance depending on an operation amount of the first directional control valve.

When the first actuator is solely driven with only the first directional control valve fully operated, the variable resisting function of the first auxiliary valve is fully opened and the variable resisting function of the fourth auxiliary valve is fully closed. Therefore, the hydraulic fluids from the first and second hydraulic pumps can be joined together and supplied to the first actuator, as with the above case (joining circuit).

When the second directional control valve is half-operated from the above state, the variable resisting function of the first auxiliary valve is gradually restricted depending on the shift amount of the second directional control valve and the first hydraulic pump is connected to the second actuator preferentially depending on an extent by which the variable resisting function of the first auxiliary valve is restricted. When the variable resisting function of the fourth auxiliary valve is fully closed with the first directional control valve fully operated, the second hydraulic pump is connected to the first actuator preferentially to a full extent (adjustment of preference degree). Therefore, all of the hydraulic fluid from the second hydraulic pump plus part of the hydraulic fluid from the first hydraulic pump are supplied to the first actuator, and most of the hydraulic fluid from the first hydraulic pump is supplied to the second actuator, enabling the first and second actuators to be simultaneously driven (preference circuit). Further, when the second directional control valve is fully operated, the variable resisting function of the first auxiliary valve is fully closed and the first hydraulic pump is connected to the second actuator preferentially to a full extent. Therefore, all of the hydraulic fluid from the second hydraulic pump is supplied to the first actuator and all of the hydraulic fluid from the first hydraulic pump is supplied to the second actuator, enabling the first and second actuators to be simultaneously driven (preference circuit). Also, if the variable resisting function of the first auxiliary valve is abruptly turned on/off when it is restricted, there would occur a shock because of the circuit being closed at the moment the second directional control valve is operated. But such a shock can be suppressed in this case because the variable resisting function of the first auxiliary valve is gradually restricted depending on the valve operation amount.

When the first actuator is solely driven with the first directional control valve half-operated, the variable resisting function of the first auxiliary valve is fully opened and the variable resisting function of the fourth auxiliary valve is throttled. Therefore, the hydraulic fluids from the first and second pumps can be joined together and supplied to the first actuator (joining function).

When the second directional control valve is half-operated from the above state, the variable resisting function of the first auxiliary valve is gradually restricted depending on the shift amount of the second directional control valve and the first hydraulic pump is connected to the second actuator preferentially depending on an extent by which the variable resisting function of the first auxiliary valve is restricted. At the same time, since the variable resisting function of the fourth auxiliary valve is restricted with the first directional control valve half-operated, the second hydraulic pump is connected to the first actuator preferentially depending on an extent by which the variable resisting function of the fourth auxiliary valve is restricted (adjustment of preference degree). Therefore, most of the hydraulic fluid from the second hydraulic pump plus part of the hydraulic fluid from the first hydraulic pump are supplied to the first actuator, and most of the hydraulic fluid from the first hydraulic pump plus part of the hydraulic fluid from the second hydraulic pump are supplied to the second actuator, enabling the first and second actuators to be simultaneously driven (preference circuit). Further, when the second directional control valve is fully operated, the variable resisting function of the first auxiliary valve is fully closed and the first hydraulic pump is connected to the second actuator preferentially to a full extent. Therefore, most of the hydraulic fluid from the second hydraulic pump is supplied to the first actuator and all of the hydraulic fluid from the second first hydraulic pump plus part of the hydraulic fluid from the hydraulic pump are supplied to the second actuator, enabling the first and second actuators to be simultaneously driven (preference circuit). In this case, it is also possible to suppress a shock otherwise occurred at the moment the second directional control valve is operated.

The transition from the sole operation of the second actuator to the combined operation of the first and second actuators is performed in a like manner to the above.

(6) In the above (5), preferably, the variable resisting function of at least one of the first and fourth auxiliary valves changes line resistance depending on a load pressure of one of the first and second auxiliary valves.

By thus changing the line resistance controlled by the variable resisting function depending on not only the operation amount of the directional control valve, but also the load pressure, the actuator can be driven with small throttling loss by utilizing the load pressure.

(7) Also, to achieve the above second object, the present invention is constituted as follows. The hydraulic system of the above (4) further comprises first and second bleed valves disposed respectively between the first and second hydraulic pumps and a reservoir, and reducing opening areas thereof depending on operation amounts of the first and second directional control valves.

In control of the first and second bleed valves, the operation amounts of the first and second directional control valves may be determined as a total of both the operation amounts or a maximum value thereof, or may be calculated by using any function. As an alternative, it is also possible to calculate proportions of the flow rate demanded for the first hydraulic pump and the flow rate demanded for the second hydraulic pump from the extent by which respective flows are throttled by the variable resisting functions, divide a total of the operation amounts by the calculated proportions, and determine part of the total amount associated with the first hydraulic pump and part of the total amount associated with the second hydraulic pump.

When the first or second actuator is solely driven, or when the first and second actuators are simultaneously driven, the first and second bleed valves are throttled to gradually increase the pump delivery pressures depending on the operation amounts of the directional control valves, thereby supplying the first and second actuators with the hydraulic fluids at flow rates corresponding to the pump delivery pressures (bleed control). By changing the respective extent by which the first and second bleed valves are throttled, therefore, flow rate characteristics (metering characteristics) of the hydraulic fluids supplied to the first and second actuators through meter-in openings of the first and second directional control valves can be changed. In this way, preference circuits constituted by the first to fourth reverse-flow preventing valves or the first and fourth auxiliary valves and bleed circuits constituted by the first and second bleed valves are separated from each other, a preference degree and metering characteristics can be set independently of each other. Further, even if the first and second directional control valves are abruptly operated at the start-up of the first or second actuator, the pump delivery pressure is gradually increased because of a time lag occurring before the pump delivery pressure rises due to throttling of the bleed valve. As a result, abrupt driving of the actuator can be avoided.

(8) In the above (4), preferably, a second auxiliary valve with a variable resisting function including a flow cutoff function is disposed, in addition to the second reverse-flow preventing valve, in the second feeder line as with the first feeder line, and a third auxiliary valve with a variable resisting function including a flow cutoff function is disposed, in addition to the third reverse-flow preventing valve, in the third feeder line as with the fourth feeder line.

With this feature, the circuit can be freely selected as follows, and design change of the circuit per model and product is facilitated.

(1) When the variable resisting functions of the first to fourth auxiliary valves are all turned off, the first and second hydraulic pumps are each connected to the first and second actuators in parallel.

(2) When the variable resisting functions of the first and third auxiliary valves are turned off and the variable resisting function of the fourth auxiliary valve is throttled depending on the operation amount of the first directional control valve, the first hydraulic pump is connected to the first and second actuators in parallel and the second hydraulic pump is connected to the first actuator preferentially.

(3) When the variable resisting functions of the first and third auxiliary valves are turned off and the variable resisting function of the second auxiliary valve is throttled depending on the operation amount of the second directional control valve, the first hydraulic pump is connected to the first and second actuators in parallel and the second hydraulic pump is connected to the second actuator preferentially.

(4) When the variable resisting functions of the second and fourth auxiliary valves are turned off and the variable resisting function of the third auxiliary valve is throttled depending on the operation amount of the first directional control valve, the first hydraulic pump is connected to the first actuator preferentially and the second hydraulic pump is connected to the first and second actuators in parallel.

(5) When the variable resisting functions of the second and fourth auxiliary valves are turned off and the variable resisting function of the first auxiliary valve is throttled depending on the operation amount of the second directional control valve, the first hydraulic pump is connected to the second actuator preferentially and the second hydraulic pump is connected to the first and second actuators in parallel.

(9) In the above (8), preferably, each of the first to fourth auxiliary valve is a single valve including a function as each of the first to fourth reverse-flow preventing valves.

(10) In the above (9), preferably, the first to fourth auxiliary valves are poppet type flow control valves comprising respectively poppet valves disposed in the first to fourth feeder lines and pilot valves for controlling the poppet valves.

By so constructing the auxiliary valves by utilizing poppet type flow control valves, a valve apparatus including a reverse-flow preventing function and a variable resisting function can be easily realized without making the valve structure complicated.

(11) Further, to achieve the above object, the present invention is constituted as follows. A hydraulic system for a hydraulic excavator comprises at first and second hydraulic pumps, a plurality of actuators including a boom cylinder, an arm cylinder, a bucket cylinder, a swing motor and first and second travel motors, and a plurality of directional control valves of closed center type including a boom directional control valve, an arm directional control valve, a bucket directional control valve, a swing directional control valve and first and second travel directional control valves for controlling respective flow rates of hydraulic fluids supplied to the boom cylinder, the arm cylinder, the bucket cylinder, the swing motor and the first and second travel motors. The hydraulic system further comprises first and second feeder lines and third and fourth feeder lines respectively connecting the first and second hydraulic pumps to pump ports of at least two of the plurality of directional control valves of closed center type, first and second reverse-flow preventing valves disposed respectively in the first and second feeder lines for preventing the hydraulic fluids from reversely flowing to the respective first and second hydraulic pumps, first and second auxiliary valves disposed respectively in the first and second feeder lines and having variable resisting functions of subsidiarily controlling flows of the hydraulic fluids from the respective first and second hydraulic pumps, third and fourth reverse-flow preventing valves disposed respectively in the third and fourth feeder lines for preventing the hydraulic fluids from reversely flowing to the respective first and second hydraulic pumps, and third and fourth auxiliary valves disposed respectively in the third and fourth feeder lines and having variable resisting functions of subsidiarily controlling flows of the hydraulic fluids supplied from the respective first and second hydraulic pumps.

By so providing the feeder lines, the reverse-flow preventing valves, and the auxiliary valves each having a variable resisting function, a joining circuit and a reference circuit can be realized with a simple structure by employing a closed center circuit, as mentioned above, in a hydraulic system for a hydraulic excavator.

(12) In the above (11), by way of example, the directional control valves are the boom directional control valve and the arm directional control valve, the first and second feeder lines are first and second boom feeder lines, the third and fourth feeder lines are first and second arm feeder lines, the first and second reverse-flow preventing valves are first and second boom reverse-flow preventing valves, the first and second auxiliary valves are first and second boom auxiliary valves, the third and fourth reverse-flow preventing valves are first and second arm reverse-flow preventing valves, and the third and fourth auxiliary valves are first and second arm auxiliary valves.

(13) Preferably, the hydraulic system of the above (12) further comprises control means for controlling the variable resisting function so as to throttle the first arm auxiliary valve when boom operating means for instructing the boom cylinder to be driven is operated.

With this feature, during the simultaneous operation of the boom and the arm, most of the hydraulic fluid from the first hydraulic pump is sent to the boom cylinder because the first arm auxiliary valve is throttled, and the hydraulic fluid from the second hydraulic pump is primarily sent to the arm cylinder.

(14) Also, the hydraulic system of the above (12) further comprises, by way of example, first and second bucket feeder lines respectively connecting the first and second hydraulic pumps to a pump port of the bucket directional control valve, first and second bucket reverse-flow preventing valves disposed respectively in the first and second bucket feeder lines for preventing the hydraulic fluids from reversely flowing to the respective first and second hydraulic pumps, and first and second bucket auxiliary valves disposed respectively in the first and second bucket feeder lines and having variable resisting functions of subsidiarily controlling flows of the hydraulic fluids supplied from the respective first and second hydraulic pumps.

(15) Preferably, the hydraulic system of the above (14) further comprises control means for controlling the variable resisting function so as to throttle the first arm auxiliary valve when boom operating means and/or bucket operating means for respectively instructing the boom cylinder and the bucket cylinder to be driven is operated.

With this feature, during the simultaneous operation of the boom or the bucket and the arm, most of the hydraulic fluid from the first hydraulic pump is sent to the boom cylinder or the bucket cylinder because the first arm auxiliary valve is throttled, and the hydraulic fluid from the second hydraulic pump is primarily sent to the arm cylinder.

(16) In the above (15), preferably, the control means controls the variable resisting function when the boom operating means, the bucket operating means, and arm operating means for instructing the arm cylinder to be driven are operated, such that the first and second boom auxiliary valves are opened, the first bucket auxiliary valve is throttled, and the second bucket auxiliary valve is closed when the boom operating means instructs boom-up, and the first boom auxiliary valve and the first bucket auxiliary valve are opened and the second boom auxiliary valve and the second bucket auxiliary valve are closed when the boom operating means instructs boom-down.

With this feature, during the combined operation of three members of the front working equipment in which the boom (boom-up), the arm and the bucket are simultaneously driven, the first arm auxiliary valve and the first bucket auxiliary valve are controlled to be throttled, the first and second boom auxiliary valves and the second arm auxiliary valve are all controlled to be opened, and the second bucket auxiliary valve is controlled to be closed. Because a load pressure in the operation of each of the arm and the bucket is lower than that in the boom-up operation, most of the hydraulic fluid from the second hydraulic pump is sent to the arm cylinder through the arm directional control valve after passing the second arm auxiliary valve, whereas most of the hydraulic fluid from the first hydraulic pump is sent to the boom cylinder and the bucket cylinder through the boom directional control valve and the bucket directional control valve after passing the first boom auxiliary valve and the first bucket auxiliary valve, thereby enabling the combined operation of three members of the front working equipment to be performed.

Also, during the combined operation of three members of the front working equipment in which the boom (boom-down), the arm and the bucket are simultaneously driven, the first arm auxiliary valve is controlled to be throttled, the first boom auxiliary valve, the second arm auxiliary valve and the first bucket auxiliary valve are all controlled to be opened, and the second boom auxiliary valve and the second bucket auxiliary valve are controlled to be closed. Therefore, the hydraulic fluid from the second hydraulic pump is sent to the arm cylinder through the arm directional control valve after passing the second arm auxiliary valve, whereas most of the hydraulic fluid from the first hydraulic pump is sent to the boom cylinder and the bucket cylinder through the boom directional control valve and the bucket directional control valve after passing the first boom auxiliary valve and the first bucket auxiliary valve, thereby enabling the combined operation of three members of the front working equipment to be performed.

(17) The hydraulic system of the above (12) further comprises, by way of example, first and second travel feeder lines respectively connecting the first and second hydraulic pumps to a pump port of the first travel directional control valve, a third travel feeder line connecting the first hydraulic pump to a pump port of the second travel directional control valve, first and second reverse-flow preventing valves disposed respectively in the first and second travel feeder lines for preventing the hydraulic fluids from reversely flowing to the respective first and second hydraulic pumps, and first and second travel auxiliary valves disposed respectively in the first and second travel feeder lines and having variable resisting functions of subsidiarily controlling flows of the hydraulic fluids supplied from the respective first and second hydraulic pumps.

(18) Preferably, the hydraulic system of the above (17) further comprises control means for controlling the variable resisting functions so as to close the first travel auxiliary valve and open the second travel auxiliary valve when only first-and-second travel operating means for instructing the first and second travel motors to be driven is operated.

With this feature, during the sole operation of travel, the first travel auxiliary valve is controlled to be closed and the second travel auxiliary valve is controlled to be opened. Therefore, the hydraulic fluid from the first hydraulic pump is sent to the second travel motor through the second travel directional control valve, and the hydraulic fluid from the second hydraulic pump is sent to the first travel motor through the second travel auxiliary valve and the first travel directional control valve.

(19) Preferably, the hydraulic system of the above (17) further comprises control means for controlling the variable resisting functions such that the first travel auxiliary valve is opened and the second travel auxiliary valve is throttled when at least boom operating means and/or arm operating means for respectively instructing the boom cylinder and the arm cylinder to be driven is operated, and at least one of the first boom auxiliary valve and the first arm auxiliary valve is throttled when the second travel operating means is operated.

With this feature, during the combined operation of plural modes including travel, for example, during the simultaneous operation of the boom and travel, the first boom auxiliary valve is controlled to be throttled as the second travel directional control valve is operated, the second travel auxiliary valve is controlled to be throttled as the boom directional control valve is operated, and the second boom auxiliary valve and the first travel auxiliary valve are both controlled to be fully opened. Therefore, most of the hydraulic fluid from the first hydraulic pump is supplied to the first and second travel motors and part thereof is also supplied to the boom cylinder after being throttled by the first boom auxiliary valve, whereas most of the hydraulic fluid from the second hydraulic pump is supplied to the boom cylinder through the second boom auxiliary valve and the boom directional control valve. As a result, sufficient forces to perform the travel and boom operations are ensured, and the combined operation including travel is implemented while preventing the excavator from traveling askew. This is equally applied to the simultaneous operation of travel combined with any other mode or member.

(20) The hydraulic system of the above (17) further comprises, by way of example, first and second bucket feeder lines respectively connecting the first and second hydraulic pumps to a pump port of the bucket directional control valve, first and second bucket reverse-flow preventing valves disposed respectively in the first and second bucket feeder lines for preventing the hydraulic fluids from reversely flowing to the respective first and second hydraulic pumps, first and second bucket auxiliary valves disposed respectively in the first and second bucket feeder lines and having variable resisting functions of subsidiarily controlling flows of the hydraulic fluids supplied from the respective first and second hydraulic pumps, and control means for controlling the variable resisting functions such that the first travel auxiliary valve is closed and the second travel auxiliary valve is opened when only first-and-second travel operating means for instructing the first and second travel motors to be driven is operated, that the first travel auxiliary valve is opened and the second travel auxiliary valve is throttled when at least one of boom operating means, arm operating means, bucket operating means and swing operating means for respectively instructing the boom cylinder, the arm cylinder, the bucket cylinder and the swing motor to be driven is operated, and that at least one of the first boom auxiliary valve, the first arm auxiliary valve and the first bucket auxiliary valve is throttled when the second travel operating means is operated.

This feature enables the hydraulic system to effect the sole operation of travel mentioned in the above (18) and the combined operation of travel with the boom, the arm, the bucket or swing mentioned in the above (19).

(21) The hydraulic system of the above (12) further comprises, by way of example, a swing feeder line for connecting the second hydraulic pump to a pump port of the swing directional control valve.

(22) Preferably, the hydraulic system of the above (21) further comprises control means for controlling the variable resisting function so as to throttle the arm auxiliary valve when swing operating means for instructing the swing motor to be driven is operated.

With this feature, during the simultaneous operation of the arm and swing, for example, the first arm auxiliary valve is controlled to be opened and the second arm auxiliary valve is controlled to be throttled. Therefore, a sufficient pressure for the swing operation is ensured and the operability in the combined operation of plural modes including swing is improved.

(23) Preferably, the hydraulic system of the above (21) further comprises control means for controlling the variable resisting functions when the boom operating means for instructing the boom cylinder to be driven is operated, such that the first and second boom auxiliary valves are both opened when the boom operating means instructs boom-up, and the first boom auxiliary valve is opened and the second boom auxiliary valve is closed when the boom operating means instructs boom-down.

With this feature, during the simultaneous operation of swing and boom-up, for example, the first and second auxiliary valves are both controlled to be fully opened so that the boom cylinder and the swing motor are connected to the first and second hydraulic pumps in parallel. As a result, the pressure for the swing operation is ensured by a boom driving pressure and the boom can be satisfactorily raised by a swing load pressure.

Also, during the simultaneous operation of swing and boom-down, the first boom auxiliary valve is controlled to be fully opened and the second boom auxiliary valve is controlled to be fully closed so that the boom cylinder is connected to the first hydraulic pump alone. As a result, the pressure for the swing operation is ensured without being affected by a low load pressure during boom-down, and the operability in the combined operation including swing is improved.

(24) Further, to achieve the above second object, the present invention is constituted as follows. The hydraulic system of the above (11) further comprises first and second bleed valves disposed respectively between the first and second hydraulic pumps and a reservoir, and reducing opening areas thereof depending on operation amounts of at least two directional control valves.

By so providing the first and second bleed valves, a preference degree and metering characteristics can be set independently of each other during the combined operation of plural actuators by employing a closed center circuit, as mentioned above, in a hydraulic system for a hydraulic excavator.

BRIEF DESCRIPTION OF THE DRAWINGS

FIG. 17 is a table showing the relationship between operating conditions and operation positions of auxiliary valves when the auxiliary valves are controlled during the sole operation.

FIG. 18 is a table showing the relationship between operating conditions and operation positions of auxiliary valves when the auxiliary valves are controlled during the combined operation including travel.

FIG. 19 is a table showing the relationship between operating conditions and operation positions of auxiliary valves when the auxiliary valves are controlled during the combined operation including swing.

FIG. 20 is a table showing the relationship between operating conditions and operation positions of auxiliary valves when the auxiliary valves are controlled during the combined operation of two members of a front working equipment.

FIG. 21 is a table showing the relationship between operating conditions and operation positions of auxiliary valves when the auxiliary valves are controlled during the combined operation of three members of a front working equipment.

FIG. 23 is an exterior view of a valve apparatus in which directional control valves, auxiliary valves and bleed valves of the hydraulic system shown in FIG. 1 are built in.

BEST MODE FOR CARRYING OUT THE INVENTION

Hereunder, embodiments of the present invention will be described with reference to the drawings.

Figure 1:
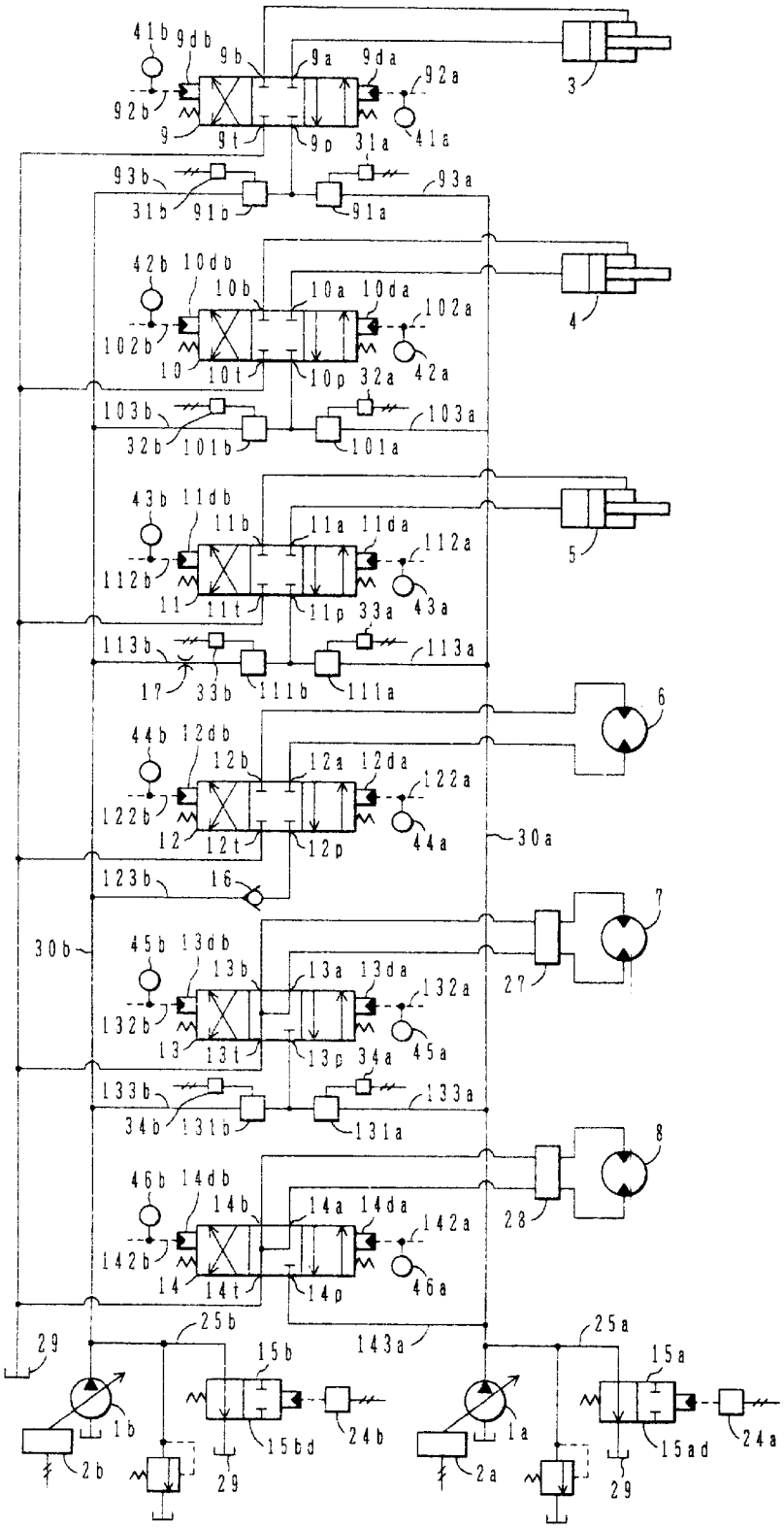
FIG. 1 is a circuit diagram of a hydraulic system according to one embodiment of the present invention.

In FIG. 1, a hydraulic system of one embodiment comprises two first and second variable displacement hydraulic pumps 1*a*, 1*b*, and regulators 2*a*, 2*b* for controlling respective capacities of the hydraulic pumps 1*a*, 1*b*. A plurality of actuators are provided, including a boom cylinder 3, an arm cylinder 4, a bucket cylinder 5, a swing motor 6 and first and second travel motors 7, 8, along with a boom directional control valve 9, an arm directional control valve 10 and a bucket directional control valve 11, each being of closed center type, connected to the first and second hydraulic pumps 1*a*, 1*b* for controlling respective flow rates of hydraulic fluids supplied to the boom cylinder 3, the arm cylinder 4 and the bucket cylinder 5. A swing directional control valve 12 of closed center type is connected to the second hydraulic pump 1*b* for controlling a flow rate of a hydraulic fluid supplied to the swing motor 6, a first travel directional control valve 13 of closed center type is connected to the first and second hydraulic pumps 1*a*, 1*b* for controlling a flow rate of hydraulic fluids supplied to the first travel motor 7, and a second travel directional control valve 14 of closed center type is connected to the first hydraulic pump 1*a* for controlling a flow rate of a hydraulic fluid supplied to the second travel motor 8.

The boom, arm, bucket, swing, and first and second travel directional control valves 9–14 are pilot-operated valves having respective pairs of pilot hydraulic driving sectors 9*da*, 9*db*; 10*da*, 10*db*; 11*da*, 11*db*; 12*da*, 12*db*, 13*da*, 13*db*;

14*da*, 14*db*, and controlled by respective pilot pressure signals 92*a*, 92*b*; 102*a*, 102*b*; 112*a*, 112*b*; 122*a*, 122*b*; 132*a*, 132*b*; 142*a*, 142*b* in a switchable manner.

The boom, arm, bucket, swing, and first and second travel directional control valves 9–14 have pump ports 9*p*, 10*p*, 11*p*, 12*p*, 13*p*, 14*p*, reservoir ports 9*t*, 10*t*, 11*t*, 12*t*, 13*t*, 14*t*, and two actuator ports 9*a*, 9*b*; 10*a*, 10*b*; 11*a*, 11*b*; 12*a*, 12*b*; 13*a*, 13*b*; 14*a*, 14*b*, respectively. The reservoir ports are all connected to a reservoir 29, and the actuator ports are connected to the corresponding hydraulic actuators. Counterbalancing valves 27, 28 are disposed respectively between the actuator ports 13*a*, 13*b* of the first travel directional control valve 13 and the first travel motor 7 and between the actuator ports 14*a*, 14*b* of the second travel directional control valve 14 and the second travel motor 8.

Also, the pump port 9*p* of the boom directional control valve 9 is connected to the first and second hydraulic pumps 1*a*, 1*b* through first and second pump lines 30*a*, 30*b* and first and second boom feeder lines 93*a*, 93*b*. The pump port 10*p* of the arm directional control valve 10 is connected to the first and second hydraulic pumps 1*a*, 1*b* through the first and second pump lines 30*a*, 30*b* and first and second arm feeder lines 103*a*, 103*b*. The pump port 11*p* of the bucket directional control valve 11 is connected to the first and second hydraulic pumps 1*a*, 1*b* through the first and second pump lines 30*a*, 30*b* and first and second bucket feeder lines 113*a*, 113*b*. The pump port 12*p* of the swing directional control valve 12 is connected to the second hydraulic pump 1*b* through the second pump line 30*b* and a swing feeder line 123*b*. The pump port 13*p* of the first travel directional control valve 13 is connected to the first and second hydraulic pumps 1*a*, 1*b* through the first and second pump lines 30*a*, 30*b* and first and second travel feeder lines 133*a*, 133*b*. The pump port 14*p* of the second travel directional control valve 14 is connected to the first hydraulic pump 1*a* through the first pump line 30*a* and a travel feeder line 143*a*.

First and second boom auxiliary valves 91*a*, 91*b* are disposed respectively in the first and second boom feeder lines 93*a*, 93*b*. Likewise, first and second arm auxiliary valves 101*a*, 101*b*, first and second bucket auxiliary valves 111*a*, 111*b*, and first and second travel auxiliary valves 131*a*, 131*b* are disposed respectively in the first and second arm feeder lines 103*a*, 103*b*, the first and second bucket feeder lines 113*a*, 113*b*, and the first and second travel feeder lines 133*a*, 133*b*. These auxiliary valves are driven by respective control pressures generated from proportional solenoid valves 31*a*, 31*b*; 32*a*, 32*b*; 33*a*, 33*b*; 34*a*, 34*b*.

The auxiliary valves 91*a*, 91*b*; 101*a*, 101*b*; 111*a*, 111*b*; 131*a*, 131*b* are poppet type valves each having both a function as a check valve to prevent the hydraulic fluids from reversely flowing back to the first and second hydraulic pumps 1*a*, 1*b*, and a variable resisting function of subsidiarily controlling flows of the hydraulic fluids supplied from the first and second hydraulic pumps 1*a*, 1*b*. The variable resisting function includes a flow cutoff function of selectively cutting off flows of the hydraulic fluids supplied from the first and second hydraulic pumps 1*a*, 1*b*. The principles of a poppet valve having such a variable resisting function are well known (see JP-A-58-501781, for example) and the disclosed poppet valve is applied as each of the auxiliary valves in this embodiment. Details of the auxiliary valve will be described below.

Disposed in the swing feeder line 123*b* is a load check valve 16 for preventing the hydraulic fluid from reversely flowing back to the second hydraulic pump 1*b* from the swing motor 6 when a load of the swing motor 6 is high. A fixed throttle 17 for limiting a bucket speed is disposed in the second bucket feeder line 113*b* upstream of the second auxiliary valve 111*b*.

First and second bleed lines 25*a*, 25*b* for connecting the first and second hydraulic pumps 1*a*, 1*b* to the reservoir 29 are branched from the first and second pump lines 30*a*, 30*b*, and first and second bleed valves 15*a*, 15*b* are disposed respectively in the first and second bleed lines 25*a*, 25*b*. The bleed valves 15*a*, 15*b* are pilot-operated valves having hydraulic driving sectors 15*ad*, 15*bd* and driven by control pressures generated from proportional solenoid valves 24*a*, 24*b*, respectively.

Figure 2:
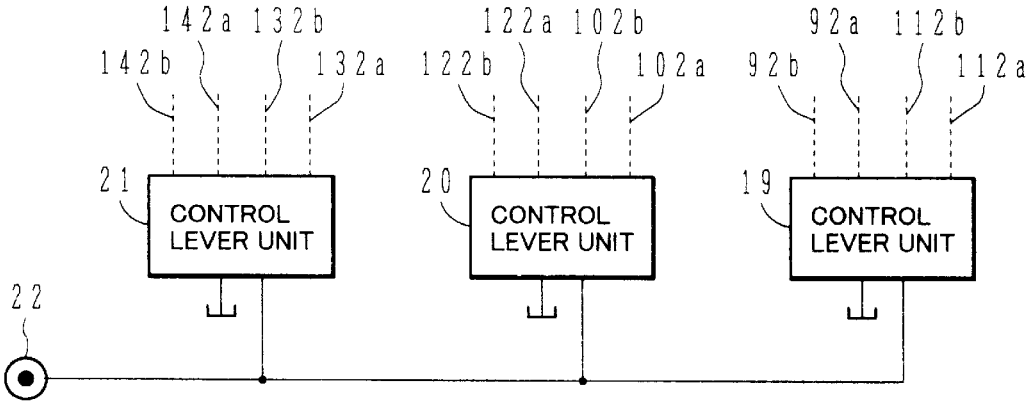
FIG. 2 is a schematic view of control lever units of the hydraulic system shown in FIG. 1.

In FIG. 2, denoted by 19, 20 and 21 are control lever units provided with pilot valves for generating pilot pressure signals 92*a*, 92*b*; 102*a*, 102*b*; 112*a*, 112*b*; 122*a*, 122*b*; 132*a*, 132*b*; 142*a*, 142*b*. The control lever unit 19 is associated with the boom and the bucket and, when its control lever is operated, the pilot valves built therein generate the pilot pressure signals 92*a*, 92*b*; 112*a*, 112*b* depending on the direction and amount in and by which the control lever is operated. The control lever unit 20 is associated with the arm and the swing motor and, when its control lever is operated, the pilot valves built therein generate the pilot pressure signals 102*a*, 102*b*; 122*a*, 122*b* depending on the direction and amount in and by which the control lever is operated. The control lever unit 21 is associated with the first and second travel motors and, when its control lever is operated, the pilot valves built therein generate the pilot pressure signals 132*a*, 132*b*; 142*a*, 142*b* depending on the direction and amount in and by which the control lever is operated. Denoted by 22 is a hydraulic source used for generating the pilot pressure signals.

Also, as control means for the auxiliary valves 91*a*, 91*b*; 101*a*, 101*b*; 111*a*, 111*b*; 131*a*, 131*b*, the bleed valves 15*a*, 15*b*, and the regulators 2*a*, 2*b*, there are provided pilot pressure sensors 41*a*, 41*b*; 42*a*, 42*b*; 43*a*, 43*b*; 44*a*, 44*b*; 45*a*, 45*b*; 46*a*, 46*b* for detecting pressures of the pilot pressure signals, and a controller 23. The controller 23 executes predetermined steps of processing based on signals from the pilot pressure sensors and outputs command signals to the proportional solenoid valves 31*a*, 31*b*–34*a*, 34*b*; 24*a*, 24*b* and the regulators 2*a*, 2*b*.

Figure 3:
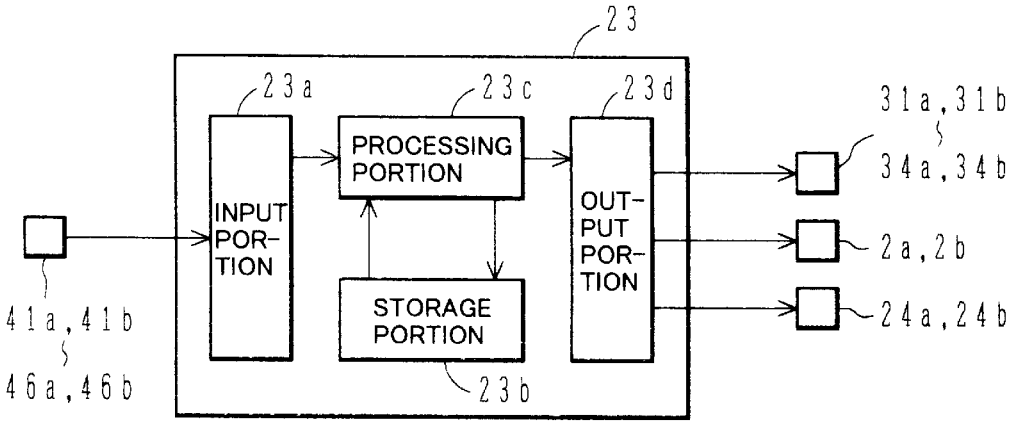
FIG. 3 is a block diagram of a controller of the hydraulic system shown in FIG. 1.

As shown in FIG. 3, the controller 23 comprises an input portion 23*a* for receiving detection signals from the pilot pressure sensors 41*a*, 41*b*–46*a*, 46*b* after A/D-conversion, a storage portion 23*b* for storing preset characteristics, a processing portion 23*c* for reading the preset characteristics from the storage portion 23*b* and executing predetermined steps of processing to calculate command signals for the proportional solenoid valves 31*a*, 31*b*–34*a*, 34*b*; 24*a*, 24*b* and the regulators 2*a*, 2*b*, and an output portion 23*d* for converting the command signals calculated by the processing portion 23*c* into driving signals and outputting the converted driving signals.

Figure 4:
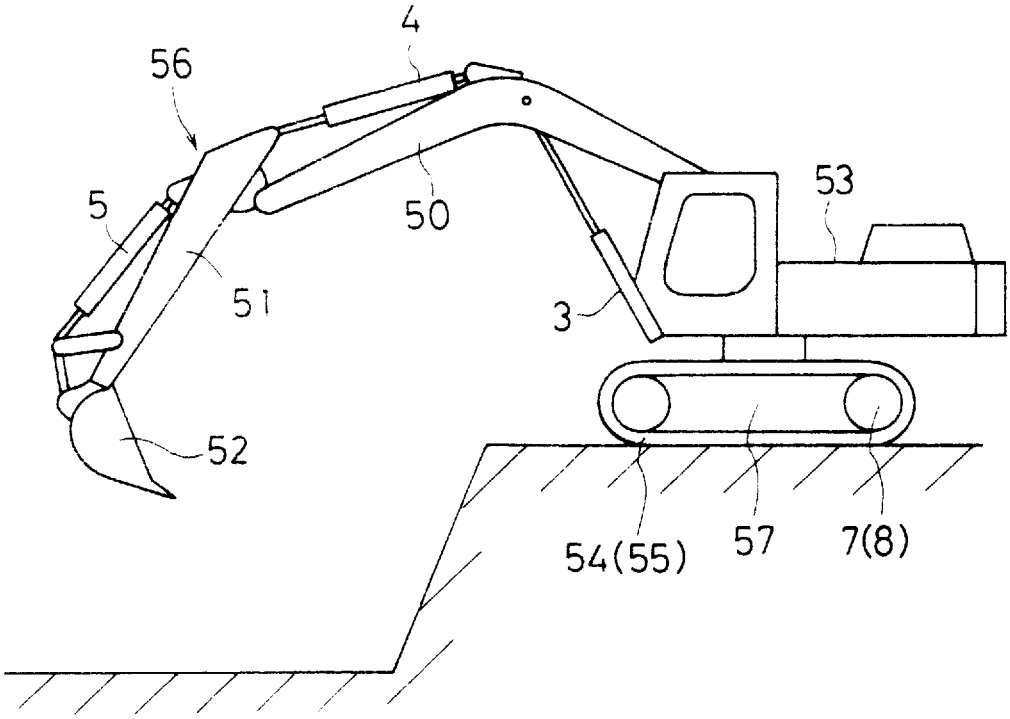
FIG. 4 is an exterior view of a hydraulic excavator on which the hydraulic system shown in FIG. 1 is equipped.

The hydraulic system of this embodiment is equipped on a hydraulic excavator as shown in FIG. 4. The hydraulic excavator comprises a boom 50 driven by the boom cylinder 3, an arm 51 driven by the arm cylinder 4, a bucket 52 driven by the bucket cylinder 5, an upper structure (swing) 53 driven by the swing motor 6, and left and right traveling devices (tracks) 54, 55 driven by the first and second travel motors 7, 8. The boom 50, the arm 51 and the bucket 52 make up a front working equipment 56 with which the excavator perform work in front of the upper structure 53. The left and right traveling devices 54, 55 make up an undercarriage 57.

The operating principles of the hydraulic system of this embodiment will be described with reference to FIGS. 5 to 15.

FIGS. 5 to 12 illustrate, in the form of circuit models, respective minimum units of the hydraulic system shown in FIG. 1 divided per function. In these drawings, pumps P1, P2 correspond to the first and second hydraulic pumps 1*a*, 1*b*; actuators A, B correspond to any two of the hydraulic actuators 3–5 and 7; valves VA, VB correspond to any two of the directional control valves 9–11 and 13; ports PA, PB correspond to any two of the pump ports 9*p*–11*p* and 13*p*, lines FA1, FA2, and FB1, FB2 correspond to any two pairs of the feeder lines 93*a*, 93*b*; 103*a*, 103*b*; 113*a*, 113*b*; and 133*a*, 133*b*, check valves CA1, CA2 and CB1, CB2 represent functions of any two pairs of the auxiliary valves 91*a*, 91*b*; 101*a*, 101*b*; 111*a*, 111*b*; and 131*a*, 131*b* as valves for preventing reverse flow (hereinafter referred to simply as reverse-flow preventing functions), on/off valves DA1, DB2 represent flow cutoff functions of any two of the auxiliary valves 91*a*, 91*b*; 101*a*, 101*b*; 111*a*, 111*b*; 131*a*, and 131*b*; variable throttle valves EA1, EA2 and EB1, EB2 represent variable resisting functions of any two pairs of the auxiliary valves 91*a*, 91*b*; 101*a*, 101*b*; 111*a*, 111*b*; 131*a*; 131*b*; valves B1, B2 correspond to the first and second bleed valves 15*a*, 15*b*, regulators R1, R2 correspond to the regulators 2*a*, 2*b*; and sensors SA1, SA2 and SB1, SB2 correspond to any two pairs of the pilot pressure sensors 41*a*, 41*b*–46*a*, 46*b*, respectively.

Note that while, in FIGS. 6 to 12, the check valves CA1, etc. are disposed in relatively upstream positions and the on/off valves DA1, etc. or the variable throttle valves EA1, etc. are disposed in relatively downstream positions in the same feeder line, the order in which those valves are disposed in the same feeder line may be reversed.

Figure 5:
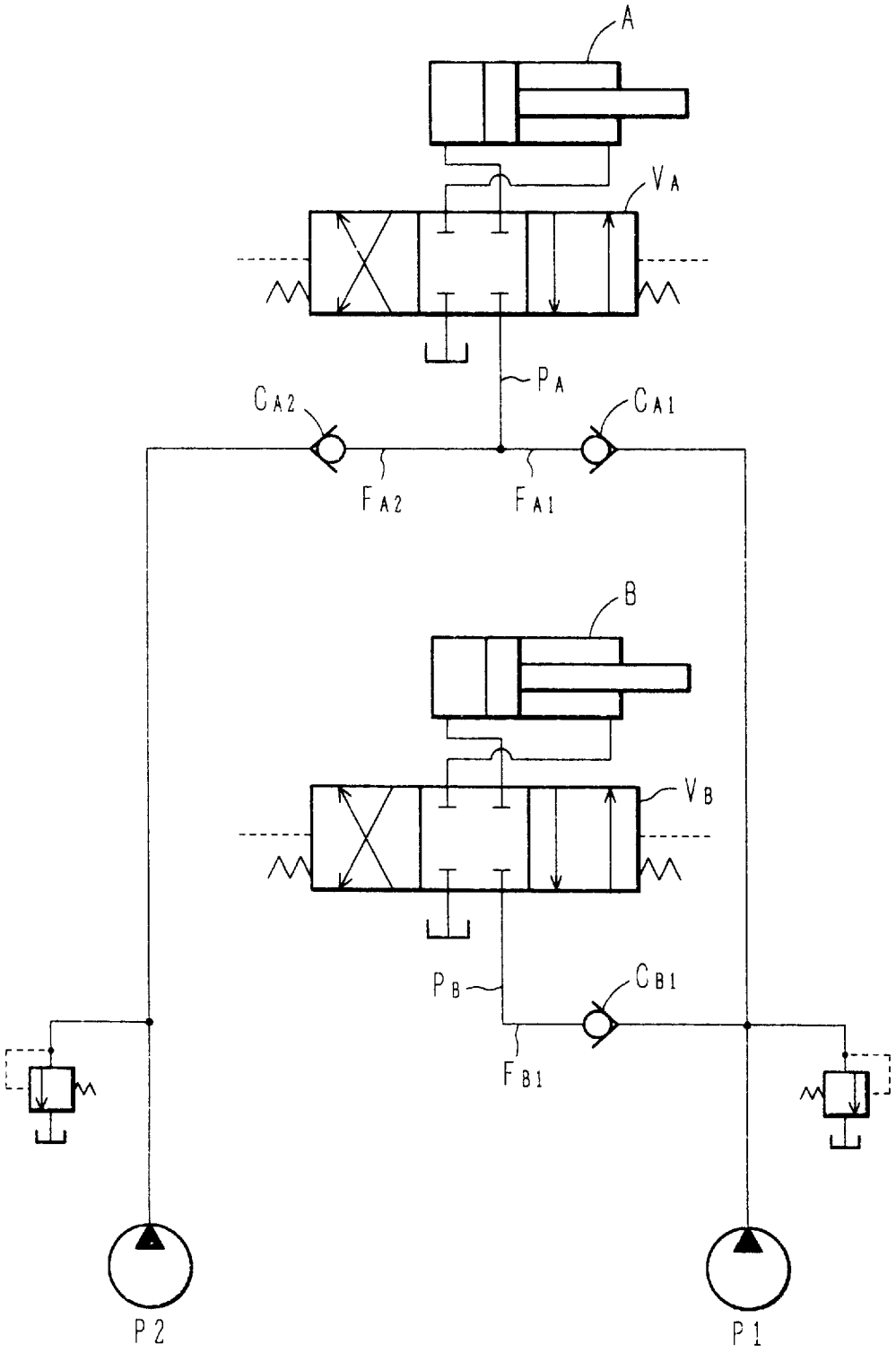
FIG. 5 is a diagram showing, in the form of a circuit model, the construction of a minimum unit relating to a reverse-flow preventing function of the hydraulic system shown in FIG. 1.

A: Reverse-flow preventing function of the auxiliary valve (FIG. 5)

(1) When the actuator A is solely driven, hydraulic fluids from the two pumps P1, P2 can be joined together and supplied to the actuator A through the feeder lines FA1, FA2 (joining circuit). Also, when the load pressure of the actuator A is higher than the delivery pressures of the pumps P1, P2, the check valves (the reverse-flow preventing functions of the auxiliary valves) CA1, CA2 prevent the hydraulic fluids from reversely flowing from the actuator to the pumps (load check function).

(2) When the actuators A, B are simultaneously driven, it is always ensured in a hydraulic system where the load pressure of the actuator A is higher than the load pressure of the actuator B that the actuator A can be operated by the hydraulic fluid from the pump P2 and the actuator B can be operated by the hydraulic fluid from the pump P1 (preference circuit). At this time, even with the load pressure of the actuator B being lower than the load pressure of the actuator B, the hydraulic fluid from the pump P2 is prevented from flowing into the actuator B by the presence of the check valve CA1.

Figure 6:
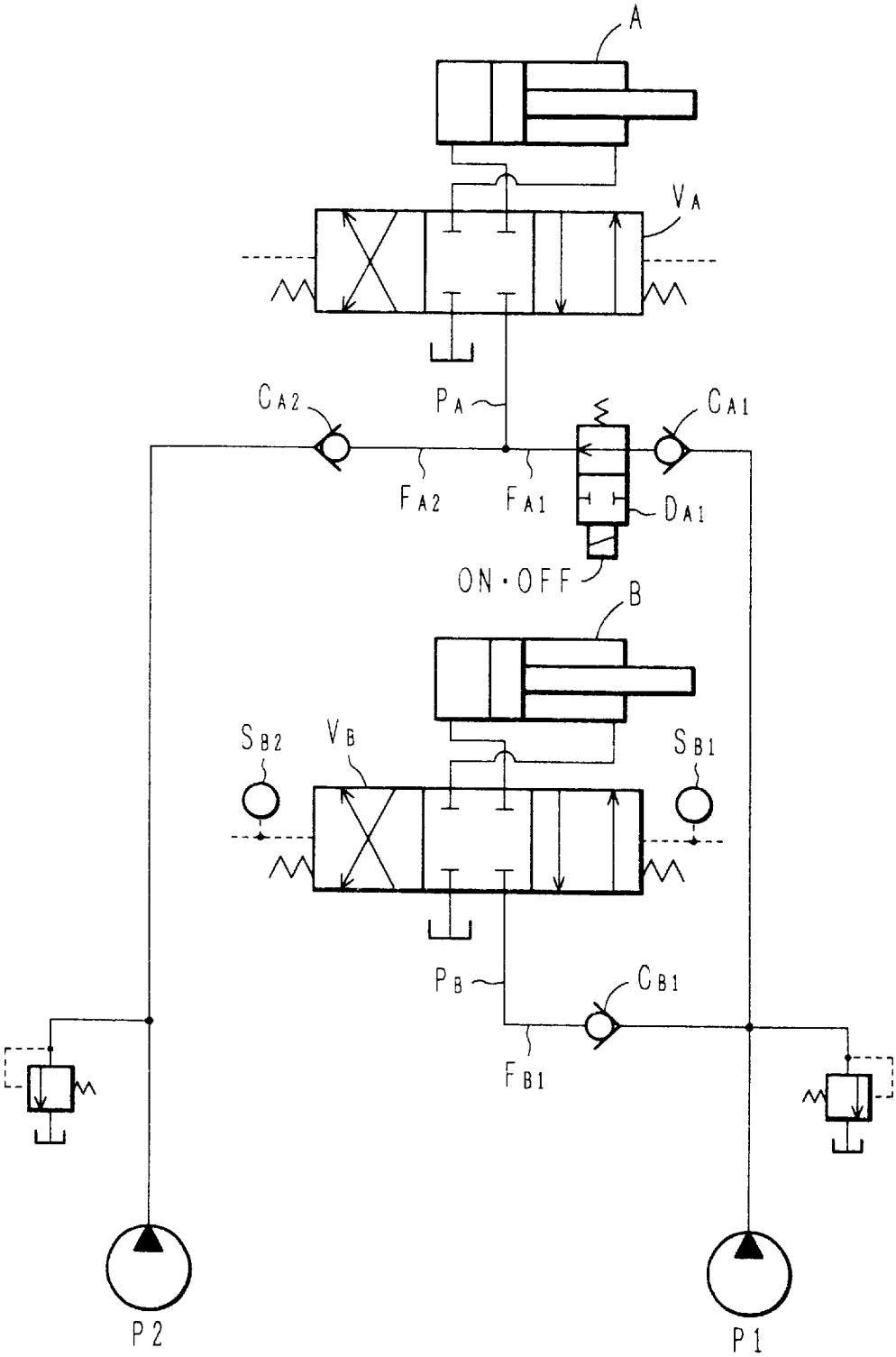
FIG. 6 is a diagram showing, in the form of a circuit model, the construction of a minimum unit relating to a reverse-flow preventing function and a flow cutoff function of the hydraulic system shown in FIG. 1.

B: Reverse-flow preventing function+flow cutoff function 1 of the auxiliary valve (FIG. 6)

(1) When the actuator A is solely driven, the hydraulic fluids from the two pumps P1, P2 can be joined together and supplied to the actuator A, as with the above case, by holding the on/off valve (the flow cutoff function of the auxiliary valve) DA1 turned off (joining circuit).

(2) When the actuators A, B are simultaneously driven, the on/off valve DA1 is turned on upon the sensors SB1, SB2 detecting an operation of the directional control valve VB, causing the pump P1 to be connected to the actuator B preferentially (i.e., in tandem). Regardless of the load pressures of the actuators A, B, therefore, the actuator A can be operated by the hydraulic fluid from the pump P2 and the actuator B can be operated by the hydraulic fluid from the pump P1 independently of each other (preference circuit).

Figure 7:
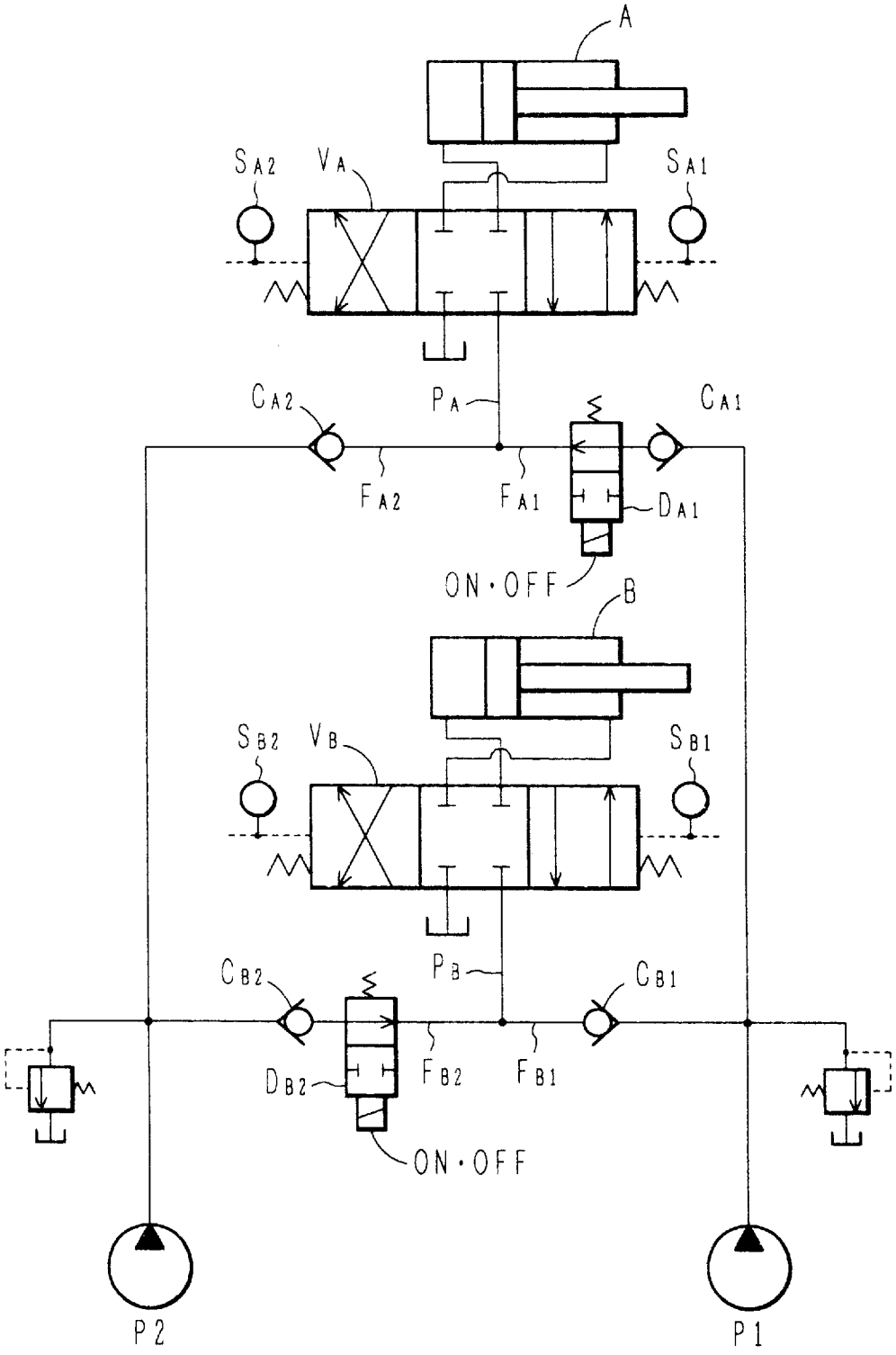
FIG. 7 is a diagram showing, in the form of a circuit model, the construction of a minimum unit relating to a reverse-flow preventing function and a flow cutoff function of the hydraulic system shown in FIG. 1, the unit being different from that of FIG. 6.

C: Reverse-flow preventing function+flow cutoff function 2 of the auxiliary valve (FIG. 7)

(1) When the actuator A is solely driven, the hydraulic fluids from the two pumps P1, P2 can be joined together and supplied to the actuator A, as with the above case, by holding the on/off valve (the flow cutoff function of the auxiliary valve) DA1 turned off (joining circuit).

(2) When the actuator B is solely driven, the hydraulic fluids from the two pumps P1, P2 can be joined together and supplied to the actuator B, as with the above case, by holding the on/off valve (the flow cutoff function of the auxiliary valve) DB2 turned off (joining circuit).

(3) When the actuators A, B are simultaneously driven, the on/off valves DA1, DB2 are turned on upon the sensors SA1, SA2 and SB1, SB2 detecting operations of the directional control valves VA, VB, respectively, causing the pump P1 to be connected to the actuator B preferentially and the pump P2 to be connected to the actuator A preferentially. Regardless of the load pressures of the actuators A, B, therefore, the actuator A can be operated by the hydraulic fluid from the pump P2 and the actuator B can be operated by the hydraulic fluid from the pump P1 independently of each other (preference circuit).

Figure 8:
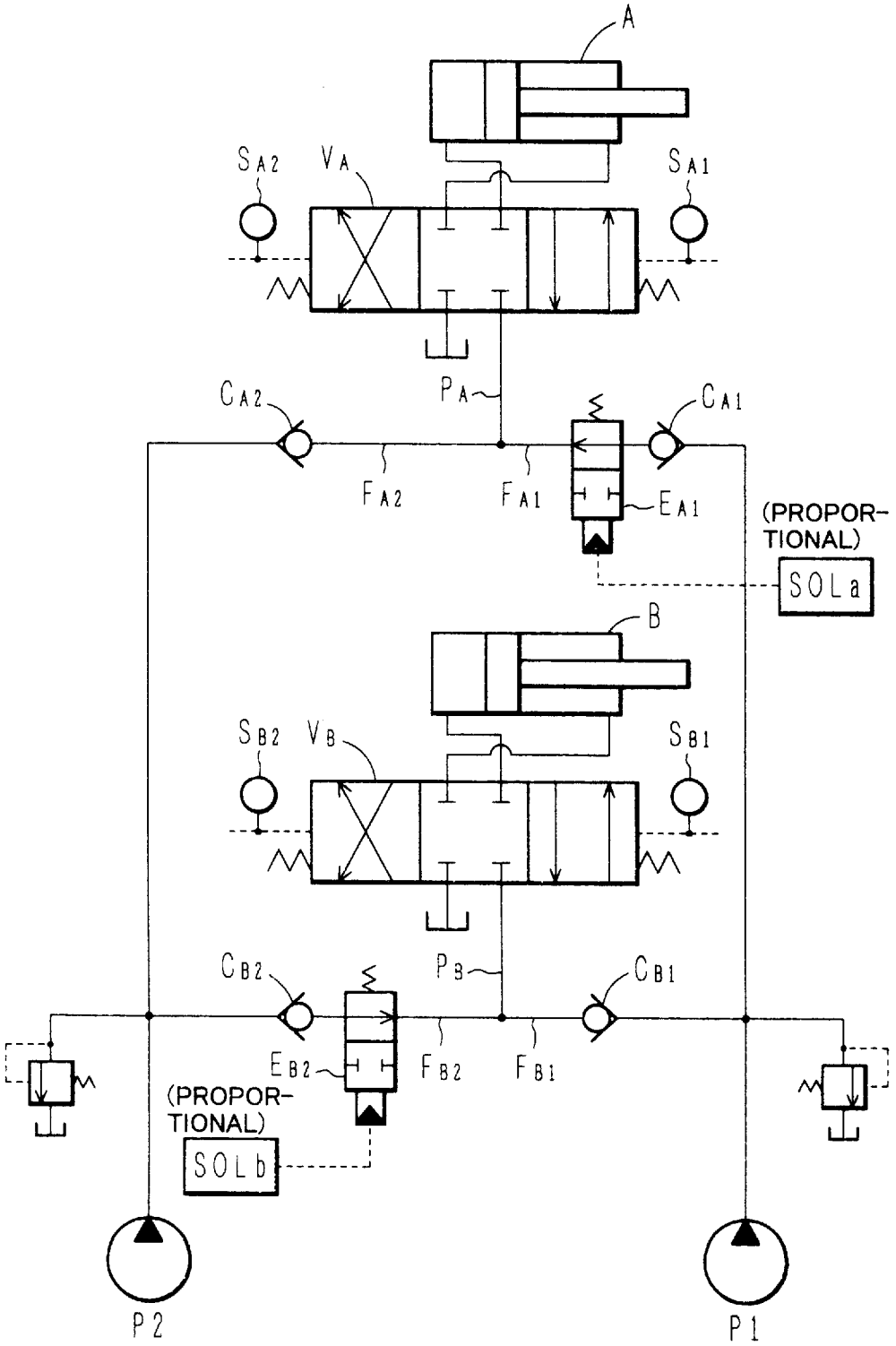
FIG. 8 is a diagram showing, in the form of a circuit model, the construction of a minimum unit relating to a reverse-flow preventing function and a variable resisting function of the hydraulic system shown in FIG. 1.

D: Reverse-flow preventing function+variable resisting function of the auxiliary valve (FIG. 8)

Figure 13:
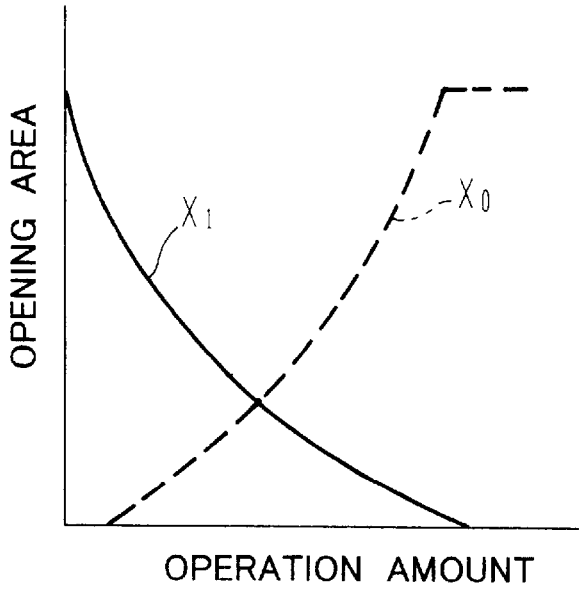
FIG. 13 is a graph showing an opening curve of an auxiliary valve.

(1) An opening area of the variable throttle valve (the variable resisting function of the auxiliary valve) EB2 and an opening area of the variable throttle valve (the variable resisting function of the auxiliary valve) EA1 are set such that, when the directional control valves VA, VB are operated, the opening areas of the variable throttle valves EB2, EA1 are each changed from a maximum value in the fully open state to a minimum value in the fully closed state, as indicated by X1 in FIG. 13, depending on respective operation amounts of the directional control valves VA, VB. In FIG. 13, X0 indicates a corresponding change in opening area of each meter-in throttle depending on the operation amounts of the directional control valves VA, VB. The operation amounts of the directional control valves VA, VB are detected by the sensors SA1, SA2 and SB1, SB2.

(2) When the actuator A is solely driven with only the directional control valve VA fully operated, the variable throttle valve EA1 is fully opened and the variable throttle valve EB2 is fully closed. Therefore, the hydraulic fluids from the two pumps P1, P2 can be joined together and supplied to the actuator A, as with the above case (joining circuit).

(3) When the directional control valve VB is half-operated from the state of (2), the variable throttle valve EA1 is gradually throttled depending on the operation amount of the directional control valve VB and the pump P1 is connected to the actuator B preferentially depending on an extent by which the variable throttle valve EA1 is throttled. When the variable throttle valve EB2 is fully closed with the directional control valve VA fully operated, the pump P2 is connected to the actuator A preferentially to a full extent (adjustment of preference degree). Therefore, all of the hydraulic fluid from the pump P2 plus part of the hydraulic fluid from the pump P1 are supplied to the actuator A, and most of the hydraulic fluid from the pump P1 is supplied to the actuator B, enabling the actuators A, B to be simultaneously driven (preference circuit). Further, when the directional control valve VB is fully operated, the variable throttle valve EA1 is fully closed and the pump P1 is connected to the actuator B preferentially to a full extent. Therefore, all of the hydraulic fluid from the pump P2 is supplied to the actuator A and all of the hydraulic fluid from the pump P1 is supplied to the actuator B, enabling the actuators A, B to be simultaneously driven (preference circuit). Also, if the variable throttle valve EA1 is abruptly turned on/off when it is throttled, there would occur a shock because of the circuit being closed at the moment the directional control valve VB is operated. But such a shock can be suppressed in this case because the variable throttle valve EA1 is gradually throttled depending on the operation amount of the directional control valve VB.

(4) When the actuator A is solely driven with the directional control valve VA half-operated, the variable throttle valve EA1 is fully opened and the variable throttle valve EB2 is throttled. Therefore, the hydraulic fluids from the two pumps P1, P2 can be joined together and supplied to the actuator A (joining function).

(5) When the directional control valve VB is half-operated from the state of (4), the variable throttle valve EA1 is gradually throttled depending on the operation amount of the directional control valve VB and the pump P1 is connected to the actuator B preferentially depending on an extent by which the variable throttle valve EA1 is throttled. At the same time, since the variable throttle valve EB2 is throttled with the directional control valve VA half-operated, the pump P2 is connected to the actuator A preferentially depending on an extent by which the variable throttle valve EB2 is throttled (adjustment of preference degree). Therefore, most of the hydraulic fluid from the pump P2 plus part of the hydraulic fluid from the pump P1 are supplied to the actuator A, and most of the hydraulic fluid from the pump PI plus part of the hydraulic fluid from the pump P2 are supplied to the actuator B, enabling the actuators A, B to be simultaneously driven (preference circuit). Further, when the directional control valve VB is fully operated, the variable throttle valve EA1 is fully closed and the pump P1 is connected to the actuator B preferentially to a full extent. Therefore, most of the hydraulic fluid from the pump P2 is supplied to the actuator A and all of the hydraulic fluid from the pump P1 plus part of the hydraulic fluid from the pump P2 are supplied to the actuator B, enabling the actuators A, B to be simultaneously driven (preference circuit). In this case, it is also possible to suppress a shock otherwise occurring at the moment the directional control valve VB is operated.

(6) The transition from the sole operation of the actuator B to the combined operation of the actuators A, B is performed in a like manner to the above (5).

(7) In the above description, the opening areas of the variable throttle valves EB2, EA1 are set such that they are each changed from a maximum value in the fully open state to a minimum value in the fully closed state, as indicated by X1 in FIG. 13, depending on the operation amounts of the directional control valves VA, VB. However, the setting may be modified such that the opening area of at least one of the variable throttle valves EB2, EA1 is changed depending on the load pressure of the actuator A or B. For example, the opening area of the variable throttle valve EB2 may be set to have a larger value as the load pressure of the actuator B increases (see FIG. 33). This may result in a smaller throttling loss produced when the hydraulic fluid from the pump P2 passes the variable throttle valve EB2, and hence smaller energy loss. Such a modification is equally applied to the following cases shown in FIGS. 9 to 12 as well. That modified embodiment will be described later with reference to FIGS. 31 to 33.

Figure 9:
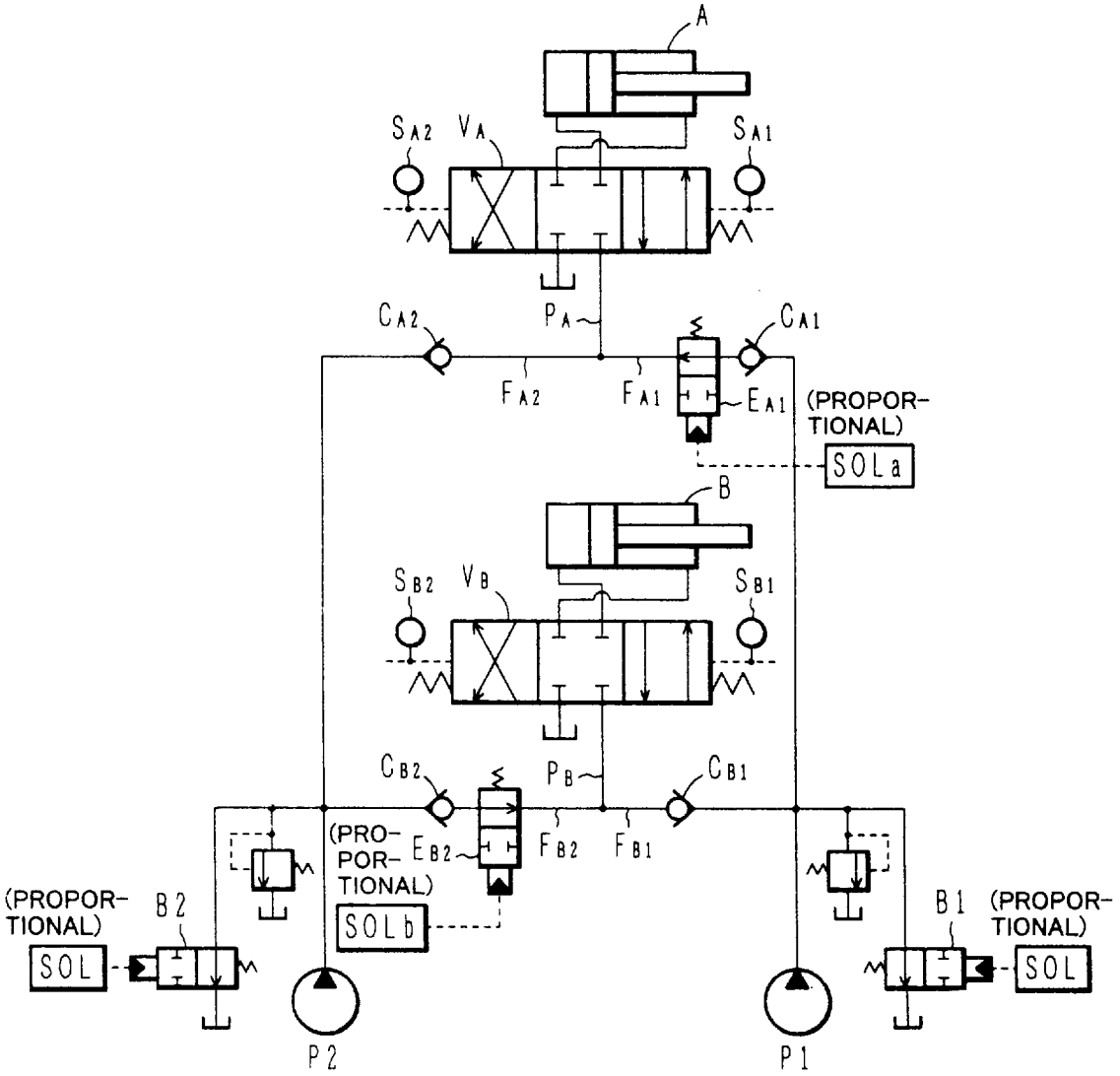
FIG. 9 is a diagram showing, in the form of a circuit model, the construction of a minimum unit relating to a reverse-flow preventing function, a variable resisting function and a bleed control function of the hydraulic system shown in FIG. 1.

E: Reverse-flow preventing function+variable resisting function of the auxiliary valve+bleed control function (FIG. 9)

Figure 14:
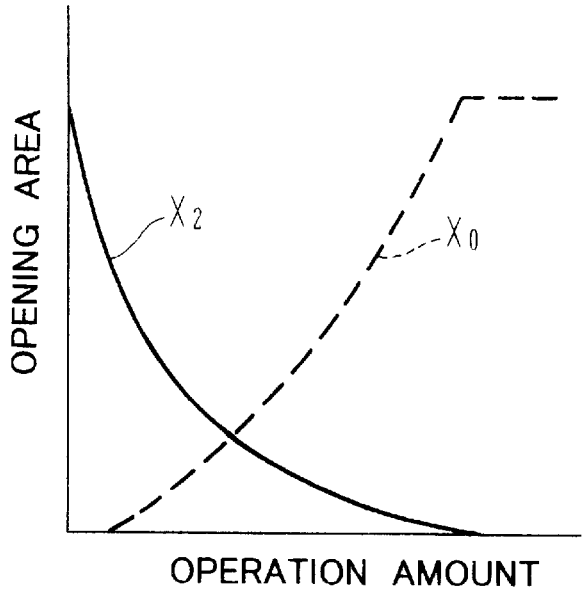
FIG. 14 is a graph showing an opening curve of a bleed valve.

(1) Opening areas of the bleed valves B1, B2 are set such that, when the directional control valves VA, VB are operated, the opening areas of the bleed valves B1, B2 are each changed from a maximum value in the fully open state to a minimum value in the fully closed state, as indicated by X2 in FIG. 14, depending on respective operation amounts of the directional control valves VA, VB. At this time, the operation amounts of the directional control valves VA, VB may be determined as a total of both the operation amounts or a maximum value thereof, or may be calculated by using any function. As an alternative, it is also possible to calculate proportions of the flow rate demanded for the first pump 1*a* and the flow rate demanded for the second pump 1*b* from the extent by which respective flows are throttled by the variable resisting functions, divide a total of the operation amounts by the calculated proportions, and determine part of the total amount associated with the pump P1 and part of the total amount associated with the pump P2. In FIG. 14, X0 indicates a corresponding change in opening area of each meter-in throttle depending on the operation amounts of the directional control valves VA, VB when solely operated.

(2) When the actuator A or B is solely driven, or when the actuators A and B are simultaneously driven, the bleed valves B1, B2 are throttled to gradually increase the pump delivery pressures depending on the operation amounts of the directional control valves VA, VB, thereby supplying the actuators A, B with the hydraulic fluids at flow rates corresponding to the pump delivery pressures (bleed control). By changing the respective extent by which the bleed valves 15*a*, 15*b* are throttled, therefore, flow rate characteristics (metering characteristics) of the hydraulic fluids supplied to the actuators A, B through meter-in openings of the directional control valves VA, VB can be changed. Further, since the pump delivery pressure is gradually increased when the actuator A or B is started up, abrupt driving of the actuator can be avoided.

Figure 10:
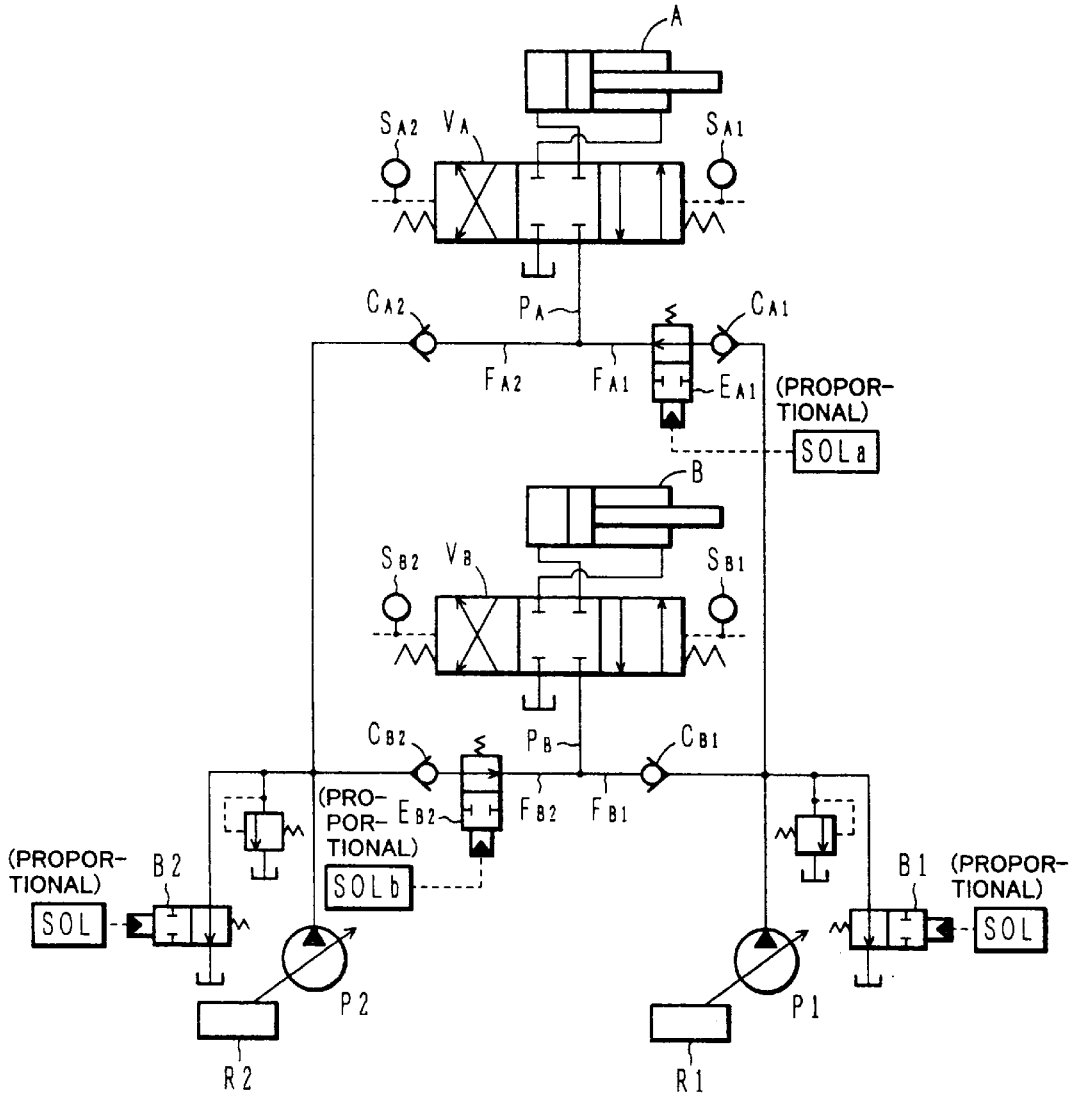
FIG. 10 is a diagram showing, in the form of a circuit model, the construction of a minimum unit relating to a reverse-flow preventing function, a variable resisting function, a bleed control function and pump control of the hydraulic system shown in FIG. 1.

F: Reverse-flow preventing function+variable resisting function of the auxiliary valve+bleed control function+pump control 1 (FIG. 10)

Figure 15:
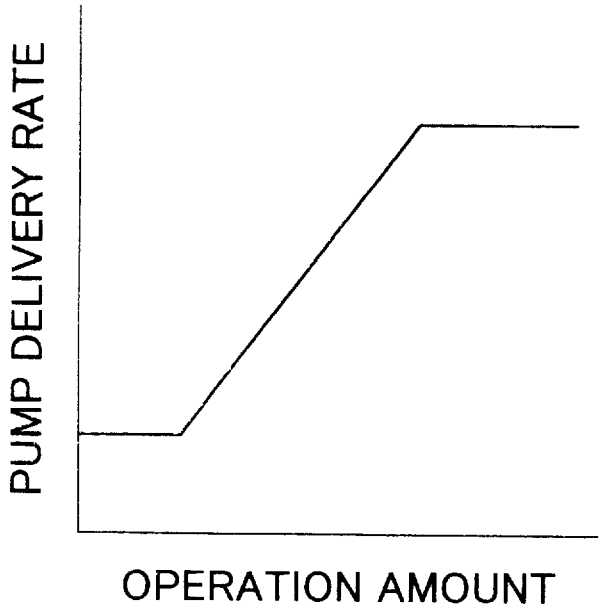
FIG. 15 is a graph showing the relationship between a valve operation amount and a target pump delivery rate in control of a hydraulic pump.

(1) Target delivery rates of the pumps P1, P2 are set such that, when the directional control valves VA, VB are operated, the target pump delivery rates are each increased, as shown in FIG. 15, depending on respective operation amounts of the directional control valves VA, VB. At this time, the operation amounts of the directional control valves VA, VB may be calculated similarly to the above case. Tiltings (displacements) of the pumps P1, P2 are then controlled by the regulators R1, R2 so that the target pump delivery rates are obtained.

(2) When the actuator A or B is solely driven, or when the actuators A and B are simultaneously driven, the delivery rates of the pumps P1 and/or P2 are gradually increased depending on the operation amounts of the directional control valves VA, VB, thereby delivering the hydraulic fluids at flow rates required (positive control).

Figure 11:
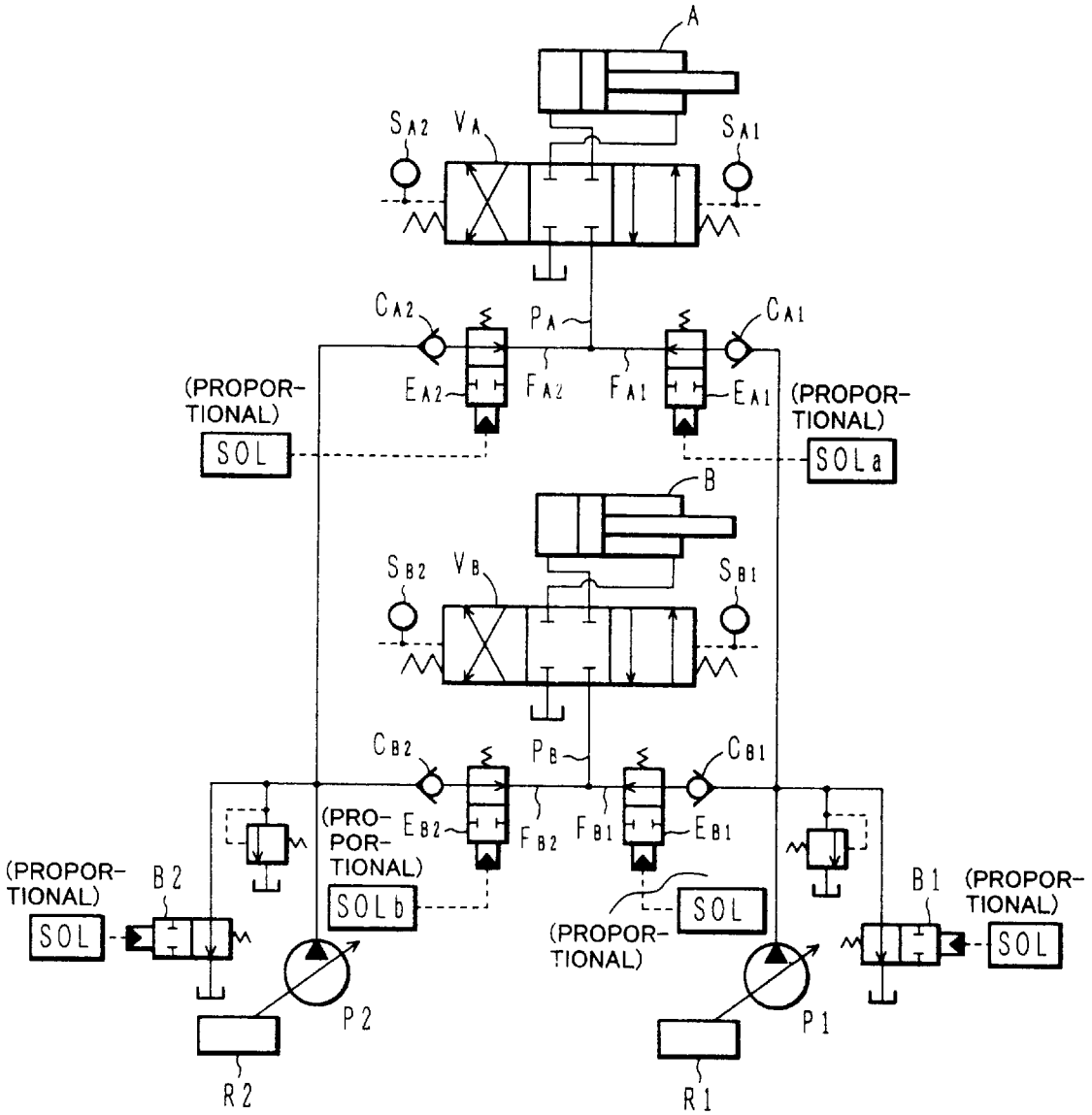
FIG. 11 is a diagram showing, in the form of a circuit model, the construction of a minimum unit relating to a reverse-flow preventing function and a variable resisting function of the hydraulic system shown in FIG. 1, the variable resisting function being developed in each feeder line.

G: Reverse-flow preventing function of the auxiliary valve+variable resisting function of each feeder line (FIG. 11)

The circuit can be freely selected as follows, and design change of the circuit per model and product is facilitated.

(1) When the variable throttle valves (variable resisting functions of the auxiliary valves) EA1, EA2 and EB1, EB2 are all turned off, the pumps P1, P2 are each connected to the actuators A, B in parallel.

(2) When the variable throttle valves EA1, EB1 are turned off and the variable throttle valve EB2 is throttled as indicated by X1 in FIG. 13 depending on the operation amount of the directional control valve VA, the pump P1 is connected to the actuators A, B in parallel and the pump P2 is connected to the actuator A preferentially.

(3) When the variable throttle valves EA1, EB1 are turned off and the variable throttle valve EA2 is throttled as indicated by X1 in FIG. 13 depending on the operation amount of the directional control valve VB, the pump P1 is connected to the actuators A, B in parallel and the pump P2 is connected to the actuator B preferentially.

(4) When the variable throttle valves EA2, EB2 are turned off and the variable throttle valve EB1 is throttled as indicated by X1 in FIG. 13 depending on the operation amount of the directional control valve VA, the pump P1 is connected to the actuator A preferentially and the pump P2 is connected to the actuators A, B in parallel.

(5) When the variable throttle valves EA2, EB2 are turned off and the variable throttle valve EA1 is throttled as indicated by X1 in FIG. 13 depending on the operation amount of the directional control valve VB, the pump P1 is connected to the actuator B preferentially and the pump P2 is connected to the actuators A, B in parallel.

Figure 12:
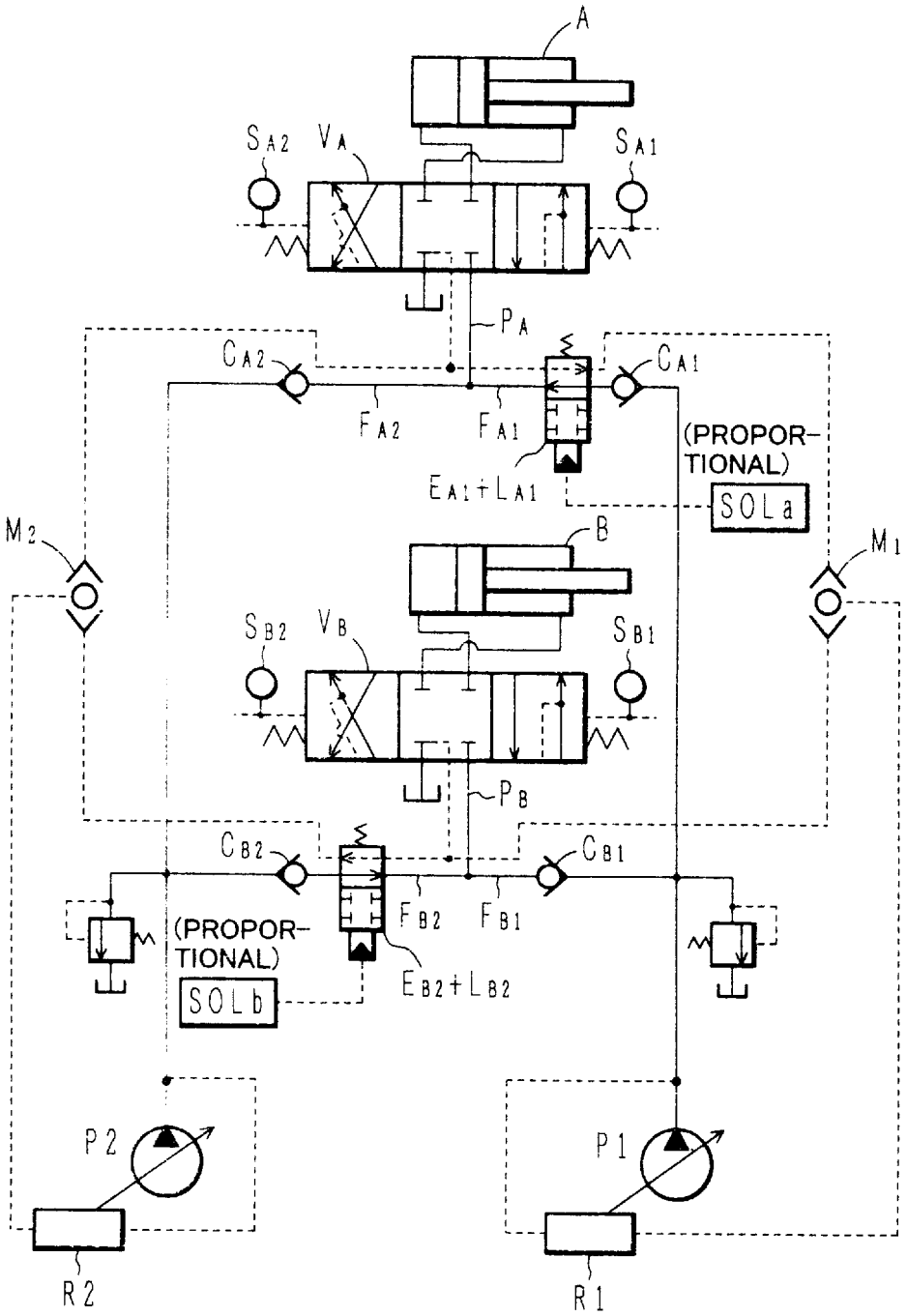
FIG. 12 is a diagram showing, in the form of a circuit model, the construction of a minimum unit when the hydraulic system shown in FIG. 1 is applied to load sensing control.

H: Reverse-flow preventing function+variable resisting function of the auxiliary valve+bleed control function+pump control 2 (FIG. 12)

(1) The load pressures of the actuators A, B are detected respectively in the directional control valves VA, VB. A higher one of the load pressures (maximum load pressure) is detected through shuttle valves M1, M2, and the regulators R1, R2 control tiltings (displacements) of the pumps P1, P2 so that the pump delivery pressure is held higher than the maximum load pressure by a predetermined value. Also, the auxiliary valves disposed in the feeder lines FA1, FB2 are constructed to have, in addition to the above-stated variable resisting functions (the variable throttle valves EA1, EB2), functions as on/off valves LA1, LB2 capable of selectively communicating and cutting off the load pressures detected in the directional control valves VA, VB.

(2) When the actuator A or B is solely driven, or when the actuators A and B are simultaneously driven, the delivery rates of the pumps P1 and/or P2 are increased depending on the operation amounts of the directional control valves VA, VB so that a differential pressure between the maximum load pressure and the pump delivery pressure is held at the predetermined value, thereby delivering the hydraulic fluids at flow rates required (load sensing control). In this way, the load sensing control can also be applied to the circuit shown in FIG. 1.

The hydraulic system of this embodiment shown in FIG. 1 has all of the above functions A to G, thus making it possible to easily construct a joining circuit and a preference circuit in the hydraulic circuit using valves of closed center type. Also, comparing the conventional open center circuit, a preference degree and metering characteristics can be set independently of each other because preference circuits constituted by the auxiliary valves 91*a*, 91*b*; 101*a*, 101*b*; 111*a*, 111*b*; 113*a*, 113*b* and bleed circuits constituted by the bleed valves 15*a*, 15*b* are separated from each other.

Processing steps executed in the processing portion 23*c* of the controller 23 in the hydraulic system of this embodiment will now be described with reference to FIGS. 16 to 21.

Figure 16:
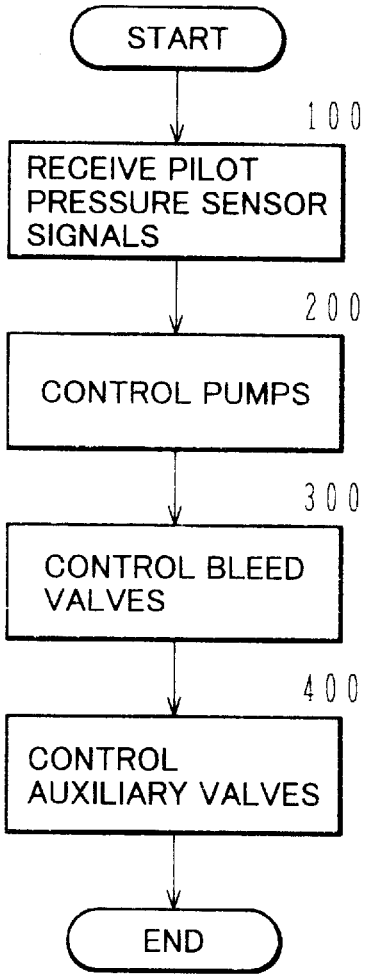
FIG. 16 is a flowchart showing processing steps in the controller.

As shown in FIG. 16, the processing portion 23*c* of the controller 23 receives the detection signals of the pilot pressure sensors 41*a*, 41*b*–46*a*, 46*b* (step 100) and, based on the received signals, carries out control of the first and second hydraulic pumps 1*a*, 1*b*, control of the first and second bleed valves 15*a*, 15*b* and control of the auxiliary valves 91*a*, 91*b*; 101*a*, 101*b*; 111*a*, 111*b*; 113*a*, 113*b* (steps 200, 300 and 400).

In the control of the hydraulic pumps 1*a*, 1*b*, as described in the above F, target delivery rates of the hydraulic pumps 1*a*, 1*b* are preset such that they are each increased, as shown in FIG. 15, depending on respective operation amounts of the directional control valves 9–14. The processing portion 23*c* calculates the target delivery rates of the first and second hydraulic pumps 1*a*, 1*b* corresponding to the operation amounts of the directional control valves 9–14 from the detection signals of the pilot pressure sensors 41*a*, 41*b*–46*a*, 46*b*, and then calculates and outputs command signals for the regulators 2*a*, 2*b* to achieve the target delivery rates. At this time, as described in the above E, the operation amounts of the directional control valves 9–14 may be determined as a total of the operation amounts or a maximum value thereof, or may be calculated by using any function. As an alternative, it is also possible to calculate proportions of the flow rate demanded for the pump 1 and the flow rate demanded for the pump 2 from the extent by which the auxiliary valves 91*a*, 91*b*; 101*a*, 101*b*; 111*a*, 111*b*; 131*a*, 131*b* are throttled, divide a total of the operation amounts by the calculated proportions, and determine part of the total amount associated with the first pump 1*a* and part of the total amount associated with the second pump 1*b*.

In the control of the bleed valves 15*a*, 15*b*, as described in the above E, target opening areas of the first and second bleed valves 15*a*, 15*b* are preset such that they are each decreased, as shown in FIG. 14, depending on respective operation amounts of the directional control valves 9–14. The processing portion 23*c* calculates the target opening areas of the first and second bleed valves 15*a*, 15*b* corresponding to the operation amounts of the directional control valves 9–14 from the detection signals of the pilot pressure sensors 41*a*, 41*b*–46*a*, 46*b*, and then calculates and outputs command signals for the proportional solenoid valves 24*a*, 24*b* to achieve the target opening areas. At this time, the operation amounts of the directional control valves 9–14 may be determined similarly to the above case. One example of such control is described in the above-cited JP-A-7-63203.

In the control of the auxiliary valves 91*a*, 91*b*; 101*a*, 101*b*; 111*a*, 111*b*; 131*a*, 131*b*, the processing portion 23*c* judges the operating conditions of the traveling devices (travel), the upper structure (swing), the boom, the arm and the bucket based on the detection signals of the pilot pressure sensors 41*a*, 41*b*–46*a*, 46*b*, determines the operation positions of the auxiliary valves 91*a*, 91*b*; 101*a*, 101*b*; 111*a*, 111*b*; 131*a*, 131*b* (i.e., whether the auxiliary valves are to be fully opened, fully closed or throttled, or to what degree they are to be throttled if so) in accordance with the judged operating conditions, and then calculates and outputs command signals for the proportional solenoid valves 31*a*, 31*b*–34*a*, 34*b* to achieve the determined operation positions.

The relationship between the valve operation amount and the target pump delivery rate as shown in FIG. 15 that is employed in the control of the hydraulic pumps 1*a*, 1*b*, the relationship between the operation amount and the opening area as shown in FIG. 14 that is employed in the control of the bleed valves 15*a*, 15*b*, and the relationships between the operating conditions and the auxiliary valve operation positions that are employed in the control of the auxiliary valves 91*a*, 91*b*; 101*a*, 101*b*; 111*a*, 111*b*; 131*a*, 131*b*, are all stored in the storage portion 23*b* of the controller 23.

The relationships between the operating conditions and the auxiliary valve operation positions that are employed in the control of the auxiliary valves are set, by way of example, as shown in FIGS. 17 to 21. FIG. 17 shows the operation positions of the auxiliary valves during the sole operation, FIG. 18 shows the operation positions of the auxiliary valves during the combined operation of two and three modes including travel, FIG. 19 shows the operation positions of the auxiliary valves during the combined operation of two and three modes including swing, FIG. 20 shows the operation positions of the auxiliary valves during the combined operation of two members of the front working equipment, and FIG. 21 shows the operation positions of the auxiliary valves during the combined operation of three members of the front working equipment, respectively. In tables of these drawings, ○ implies that the auxiliary valve is fully opened, x implies that it is fully closed, and Δ implies that it is throttled. Also, ( )represents the operation position in a standby state.

Figure 22:
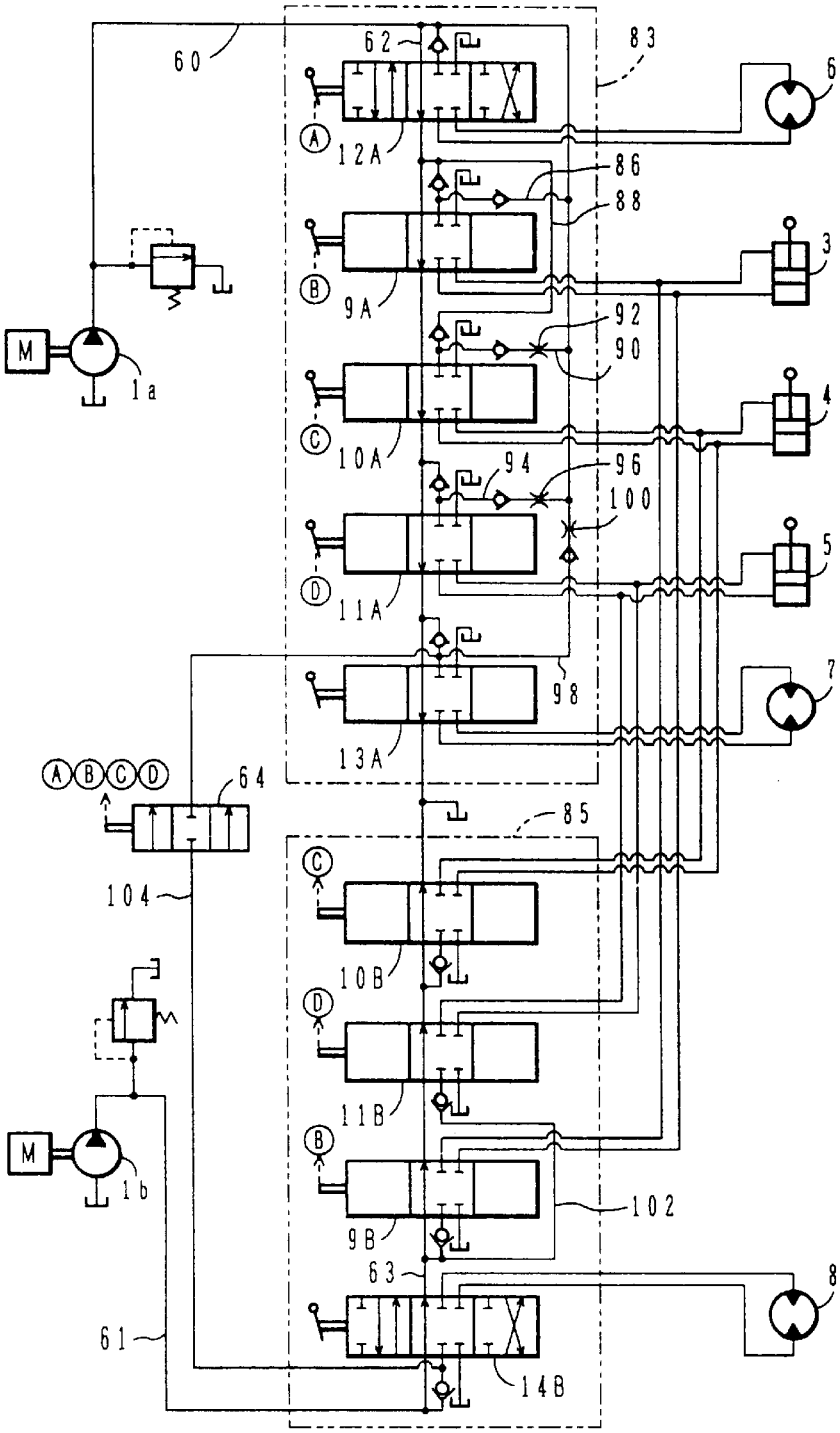
FIG. 22 is a circuit diagram showing a conventional open center circuit called OHS.

The settings of FIGS. 17 to 21 are intended to, in the hydraulic system shown in FIG. 1, realize a circuit equivalent to a conventional open center circuit, called OHS, shown in FIG. 22 and achieve the functions which are not obtained by the conventional open center circuit. The conventional open center circuit shown in FIG. 22 is the same as shown in FIG. 1 of the above-cited JP-B-2-16416. In FIG. 22, hydraulic pumps and actuators are denoted by the same reference numerals as in FIG. 1 of the drawings attached to this application. Directional control valves are divided into two valve groups 83, 84 corresponding to two hydraulic pumps 1*a*, 1*b* and are denoted by the same reference numerals as the directional control valves in FIG. 1, but affixed with A, B corresponding to the two valve groups. Denoted by 60, 61 are pump lines, 62, 63 are center bypass lines, 64 is an on/off valve for travel, 86, 88, 90, 94, 102, 104 are bypass lines, and 92, 96 are fixed throttles.

In the open center circuit shown in FIG. 22, a joining circuit is realized by providing two directional control valves belonging respectively to the two valve groups 83, 85 for one actuator. Also, in each valve group, a preference circuit is selectively realized in a combination of a tandem connection by which pump ports of the directional control valves are connected to only the center bypass lines 62, 63, and a parallel connection by which the pump ports of the directional control valves are connected to only the center bypass lines 62, 63 through the bypass lines 86, 88, 90, 94, 102. Then, a preference degree is adjusted by providing the fixed throttles 92, 96 in the bypass lines. Furthermore, the preference circuit is set as follows. In the valve group 83, connection is made such that front actuators 3–5 are driven by the pump 1*a* more preferentially than a travel motor 7. In the valve group 85, connection is made such that a travel motor 8 is driven by the pump 1*b* more preferentially than the front actuators 3–5. A travel directional control valve 13A and a travel directional control valve 14B are connected to each other through the bypass line 104 and, when the front actuators 3 –5 are driven, the on/off valve 64 disposed in the bypass line 104 is opened to supply a hydraulic fluid from the pump 1*b* to the two travel motors 7, 8 in parallel.

The hydraulic system of this embodiment shown in FIG. 1 operates as described below based on the settings of FIGS. 17 to 21 to realize a circuit equivalent to the conventional open center circuit and achieve the functions which are not obtained by the conventional open center circuit.

First, a description will be made on the sole operation of travel, the sole operation of boom-up, and the combined operation of travel and boom-up.

During the sole operation of travel, the auxiliary valve 131*a* is controlled to be fully closed and the auxiliary valve 131*b* is controlled to be fully opened (FIG. 17), so that the hydraulic fluid from the first hydraulic pump 1*a* is sent to the second travel motor 8 through the directional control valve 14 and the hydraulic fluid from the second hydraulic pump 1*b* is sent to the first travel motor 7 through the auxiliary valve 131*b* and the directional control valve 13.

Next, during the sole operation of boom-up, the auxiliary valves 91*a*, 91*b* are both controlled to be fully opened (FIG. 17), so that the hydraulic fluids from the hydraulic pumps 1*a*, 1*b* are joined together and sent to the boom cylinder 3 through the directional control valve 9.

During the combined operation of travel and boom-up, the auxiliary valve 91*a* is controlled to be throttled as the travel directional control valve 14 is operated, the auxiliary valve 131*b* is controlled to be throttled as the boom directional control valve 9 is operated, and the auxiliary valves 91*b*, 131*a* are both controlled to be fully opened (FIG. 18). At this time, when the sole operation of travel is changed to the combined operation of travel and boom-up, it is preferable to provide some time lag in the transition because there occurs a large shock on the travel if the auxiliary valve 131*b* is abruptly throttled. Also, the auxiliary valve 131*b* is only required to be throttled to such an extent as producing a pressure enough to surely raise the boom cylinder 3, and is not required to be fully closed. Further, in order to avoid the effect of a low travel load pressure as experienced, e.g., when the excavator travels over a downslope, the auxiliary valve 131*b* may be fully closed after the lapse of a predetermined time. The auxiliary valve 131*a* is fully opened at the same time as when the boom is operated. By controlling the auxiliary valves in that way, during the combined operation of travel and boom-up, most of the hydraulic fluid from the hydraulic pump 1*a* is supplied to the travel motors 7, 8 and part thereof is also supplied to the boom cylinder 3 after being throttled by the auxiliary valve 91*a*, whereas most of the hydraulic fluid from the hydraulic pump 1*b* is supplied to the boom cylinder 3 through the auxiliary valve 91*b* and the directional control valve 9. As a result, it is possible not only to ensure sufficient forces to perform the travel and boom operations, but also to prevent the excavator from traveling askew.

During the combined operation of travel combined with another mode, the auxiliary valves are likewise controlled such that the auxiliary valve 131*a* is opened, the auxiliary valve 131*b* is throttled, and the auxiliary valve located on the same side as the hydraulic pump 1*a* and associated with the directional control valve for an operation other than travel is throttled (FIG. 18).

As described above, during the combined operation of travel and boom-up, the auxiliary valve 131*b* is throttled as the boom directional control valve 9 is operated, the auxiliary valve 131*a* is fully opened, and the auxiliary valve 91*a* is throttled as the travel directional control valve 14 is operated. In this process, the throttling operation of the auxiliary valve 131*b* corresponds to the operation of throttling an opening of the center bypass line 62 of the boom directional control valve 9A in the conventional open center circuit shown in FIG. 22, and the throttling operation of the auxiliary valve 91*a* corresponds to the operation of throttling an opening of the center bypass line 63 of the travel directional control valve 14B in the conventional open center circuit. These throttling operations each have a function of determining a preference degree in the combined operation. The opening operation of the auxiliary valve 131*a* corresponds to the opening operation of the on/off valve 64 in the conventional open center circuit.

Here, in the conventional open center circuit, characteristics (opening curves) of the openings of the center bypass lines versus the operation amounts of the boom directional control valve 9A and the travel directional control valve 14B have functions of determining both a preference degree in the combined operation and metering characteristics developed when the respective directional control valves are operated. Thus, the characteristics (opening curves) of the openings of the center bypass lines versus the operation amounts of the directional control valves are determined based not on operability in the combined operation, but on the metering characteristics of the respective directional control valves. Accordingly, when the boom and the traveling devices are half-operated, it has sometimes occurred that the travel speed change is so large as to pose an inconvenience in operation of the excavator.

In the present invention, since the preference circuit made up of the auxiliary valves 91*a*, 131*b* and the bleed circuit made up of the first and second bleed valves 15*a*, 15*b* are separated from each other, metering characteristics developed when the directional control valves 9, 13, 14 are operated are determined by the relationships between respective meter-in and meter-out throttles provided in the directional control valves and opening areas of the bleed valves 15*a*, 15*b*, and a preference degree in the combined operation is determined by the extent by which the auxiliary valves 91*a*, 131*b* are throttled. Therefore, the metering characteristics in the sole operation and the preference degree in the combined operation can be optimally determined independently of each other, and operability in the combined operation can be improved. Without being limited to the combined operation of travel and boom-up, this is also equally applied to the combined operation of other modes described later.

During the combined operation of the bucket and travel, since there is no demand for moving the bucket cylinder 5 fast, the auxiliary valve 111*b* is not required to be fully opened. To this end, the fixed throttle 17 may be disposed in series with respect to the auxiliary valve 111*b* as shown in FIG. 1. Alternatively, a maximum opening of the auxiliary valve 111*b* may be restricted.

A description will now be made on the sole operation of swing, the sole operation of the arm, and the simultaneous operation of the arm and swing.

During the sole operation of swing, the hydraulic fluid from the hydraulic pump 1*b* is supplied to the swing motor 6 through the directional control valve 12. On this occasion, the hydraulic fluid is not throttled in this embodiment because the swing directional control valve 12 is provided with no auxiliary valve, but with an ordinary load check valve 16 alone. Of course, an auxiliary valve may be associated with the travel directional control valve.

During the sole operation of the arm, the auxiliary valves 101*a*, 101*b* are both controlled to be fully opened (FIG. 17), so that the hydraulic fluid from the hydraulic pump 1*a* is sent to the directional control valve 10 and the arm cylinder 4 through the auxiliary valve 101*a* and the hydraulic fluid from the hydraulic pump 1*b* is joined with the hydraulic fluid from the hydraulic pump 1*a* after passing the auxiliary valve 101*b*.

During the simultaneous operation of the arm and swing, the arm auxiliary valve 101*a* is controlled to be fully opened and the arm auxiliary valve 101*b* is controlled to be throttled (FIG. 19). With this control, a sufficient pressure for the swing operation is ensured during the combined operation of the arm and swing, and the operability in the combined operation including swing is improved. The auxiliary valve 101*b* may be throttled by restricting a maximum opening, or depending on the operation amount of the swing directional control valve 12. Additionally, the arm operation is divided into arm crowding and arm dumping. Since the arm crowding is performed under a relatively light load, the extent by which the auxiliary valve 101*b* is throttled is changed between the arm crowding and arm dumping so that it is throttled to a larger extent in the arm crowding.

The sole operation of the boom and the simultaneous operation of the boom and swing will now be described.

During the sole operation of boom-up, the auxiliary valves 91*a*, 91*b* are both controlled to be fully opened (FIG. 17), so that the hydraulic fluids from the hydraulic pumps 1*a*, 1*b* are joined together after passing the auxiliary valves 91*a*, 91*b* and then sent to the directional control valve 9 and the boom cylinder 3. During the sole operation of boom-down, the flow supplied from only one pump is sufficient for the operation. Therefore, the auxiliary valve 91*a* is controlled to be fully opened and the auxiliary valve 91*b* is controlled to be fully closed (FIG. 17), so that the hydraulic fluid from the hydraulic pump 1*a* is sent to the directional control valve 9 and the boom cylinder 3 through the auxiliary valve 91*a*.

During the simultaneous operation of swing and boom-up, the auxiliary valves 91*a*, 91*b* are both controlled to be fully opened (FIG. 19) similarly to the sole operation of boom-up, so that the boom cylinder 3 and the swing motor 6 are connected to the two hydraulic pumps 1*a*, 1*b* in parallel. As a result, the pressure for the swing operation can be ensured by a boom driving pressure and the boom can be satisfactorily raised by a swing load pressure.

During the simultaneous operation of swing and boom-down, the auxiliary valve 91*a* is controlled to be fully opened and the auxiliary valve 91*b* is controlled to be fully closed (FIG. 19) similarly to the sole operation of boom-down, so that the boom cylinder 3 is connected to the hydraulic pump 1*a* alone. As a result, the pressure for the swing operation is ensured without being affected by a low load pressure during boom-down, and the operability in the combined operation including swing is improved. That function of enabling the boom cylinder to be connected to the hydraulic pumps 1*a*, 1*b* in different ways between boom-up and boom-down is not provided in the conventional open center circuit.

The simultaneous operation of the boom and the arm will now be described. The sole operation of the boom and the sole operation of the have been described above. During the simultaneous operation of the arm and boom-up, the auxiliary valves 91*a*, 91*b*, 101*b* are all controlled to be fully opened and the auxiliary valve 101*a* is controlled to be throttled depending on the operation amount of the boom directional control valve 9 (FIG. 20). Because a boom-up load pressure is high during the simultaneous operation of the arm and boom-up, the hydraulic fluid from the hydraulic pump 1*b* is primarily sent to the arm cylinder 4 through the auxiliary valve 101*b* and the directional control valve 10. Most of the hydraulic fluid from the hydraulic pump 1*a* is sent to the boom cylinder 3 because the auxiliary valve 101*a* is throttled.

During the simultaneous operation of the arm and boom-down, the auxiliary valves 91*a*, 101*b* are both controlled to be fully opened, the auxiliary valve 91*b* is controlled to be fully closed, and the auxiliary valve 101*a* is controlled to be throttled depending on the operation amount of the boom directional control valve 9 (FIG. 20). Because a boom-down load pressure is low during the simultaneous operation of the arm and boom-down, the hydraulic fluid from the hydraulic pump 1*b* is sent to the arm cylinder 4 by fully closing the auxiliary valve 91*b*. Most of the hydraulic fluid from the hydraulic pump 1*a* is sent to the boom cylinder 3 because the auxiliary valve 101*a* is throttled.

The sole operation of the bucket and the combined operation including the bucket will now be described.

During the sole operation of the bucket, when the bucket is solely operated in a bucket crowding mode, the auxiliary valves 111*a*, 111*b* are both controlled to be fully opened (FIG. 17), so that the hydraulic fluid from the hydraulic pump 1*a* is sent to the bucket cylinder 5 through the directional control valve 11 after passing the auxiliary valve 111*a*, and the hydraulic fluid from the hydraulic pump 1*b* is joined therewith after passing the fixed throttle 17 and the auxiliary valve 111*b* and then also sent to the bucket cylinder 5 through the directional control valve 11. When the bucket is solely operated in a bucket dumping mode, the auxiliary valve 111*a* is controlled to be fully opened and the auxiliary valve 111*b* is controlled to be fully closed, so that the hydraulic fluid from the hydraulic pump 1*a* is sent to the bucket cylinder 5 through the directional control valve 11 after passing the auxiliary valve 111*a*.

During the simultaneous operation of the arm and the bucket, the auxiliary valve 101*a* is controlled to be throttled depending on the operation amount of the bucket directional control valve 11, and the auxiliary valves 101*b*, 111*a*, 111*b* are all controlled to be fully opened (FIG. 20). Therefore, most of the hydraulic fluid from the hydraulic pump 1*a* is sent to the bucket cylinder 5 through the directional control valve 11 after passing the auxiliary valve 111*a*, whereas most of the hydraulic fluid from the hydraulic pump 1*b* is sent under an action of the fixed throttle 17 to the arm cylinder 4 through the directional control valve 10 after passing the auxiliary valve 101*b*, thereby enabling the simultaneous operation to be performed.

During the combined operation of three members of the front working equipment in which the boom (boom-up), the arm and the bucket are simultaneously driven, the auxiliary valve 101*a* is controlled to be throttled depending on the operation amounts of the boom directional control valve 9 and the bucket directional control valve 11, the auxiliary valve 101*a* is controlled to be throttled depending on the operation amounts of the boom directional control valve 9 and the arm directional control valve 10, the auxiliary valves 91*a*, 91*b*, 101*b* are all controlled to be fully opened, and the auxiliary valve 111*b* is controlled to be fully closed (FIG. 21). Because a load pressure in the operation of each of the arm and the bucket is lower than that in the boom-up operation, most of the hydraulic fluid from the hydraulic pump 1*b* is sent to the arm cylinder 4 through the directional control valve 10 after passing the auxiliary valve 101*b*, whereas most of the hydraulic fluid from the hydraulic pump 1*a* is sent to the boom cylinder 3 and the bucket cylinder 5 through the directional control valves 9, 11 after passing the auxiliary valves 91*a*, 111*a*, thereby enabling the combined operation of three members of the front working equipment to be performed.

During the combined operation of three members of the front working equipment in which the boom (boom-down), the arm and the bucket are simultaneously driven, the auxiliary valve 101*a* is controlled to be throttled depending on the operation amount of the boom directional control valve 9, the auxiliary valves 91*a*, 101*b*, 111*a* are all controlled to be fully opened, and the auxiliary valves 91*b*, 111*b* are controlled to be fully closed (FIG. 21). Therefore, the hydraulic fluid from the hydraulic pump 1*b* is sent to the arm cylinder 4 through the directional control valve 10 after passing the auxiliary valve 101*b*, whereas most of the hydraulic fluid from the hydraulic pump 1*a* is sent to the boom cylinder 3 and the bucket cylinder 5 through the directional control valves 9, 11 after passing the auxiliary valves 91*a*, 111*a*, thereby enabling the combined operation of three members of the front working equipment to be performed.

In this way, the combined operation of three members of the front working equipment, which has been difficult to realize in the conventional open center circuit, can be easily implemented.

Next, an embodiment of a valve apparatus including the directional control valves 9–14, the auxiliary valves 91*a*, 91*b*; 101*a*, 101*b*; 111*a*, 111*b*; 131*a*, 131*b*, and the bleed valves 15*a*, 15*b* will be described with reference to FIGS. 23 to 29.

Figure 23:
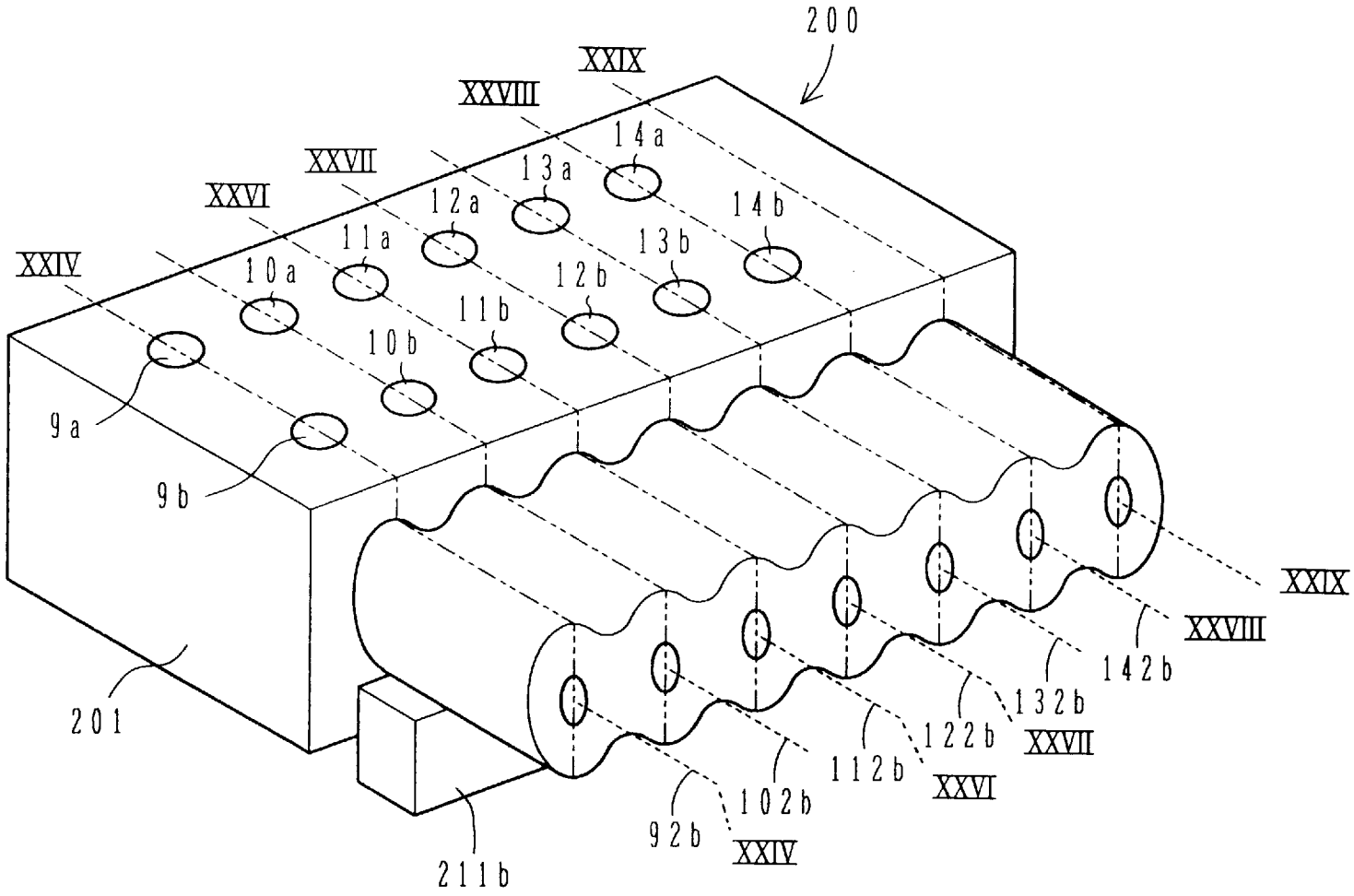
Figure 24:
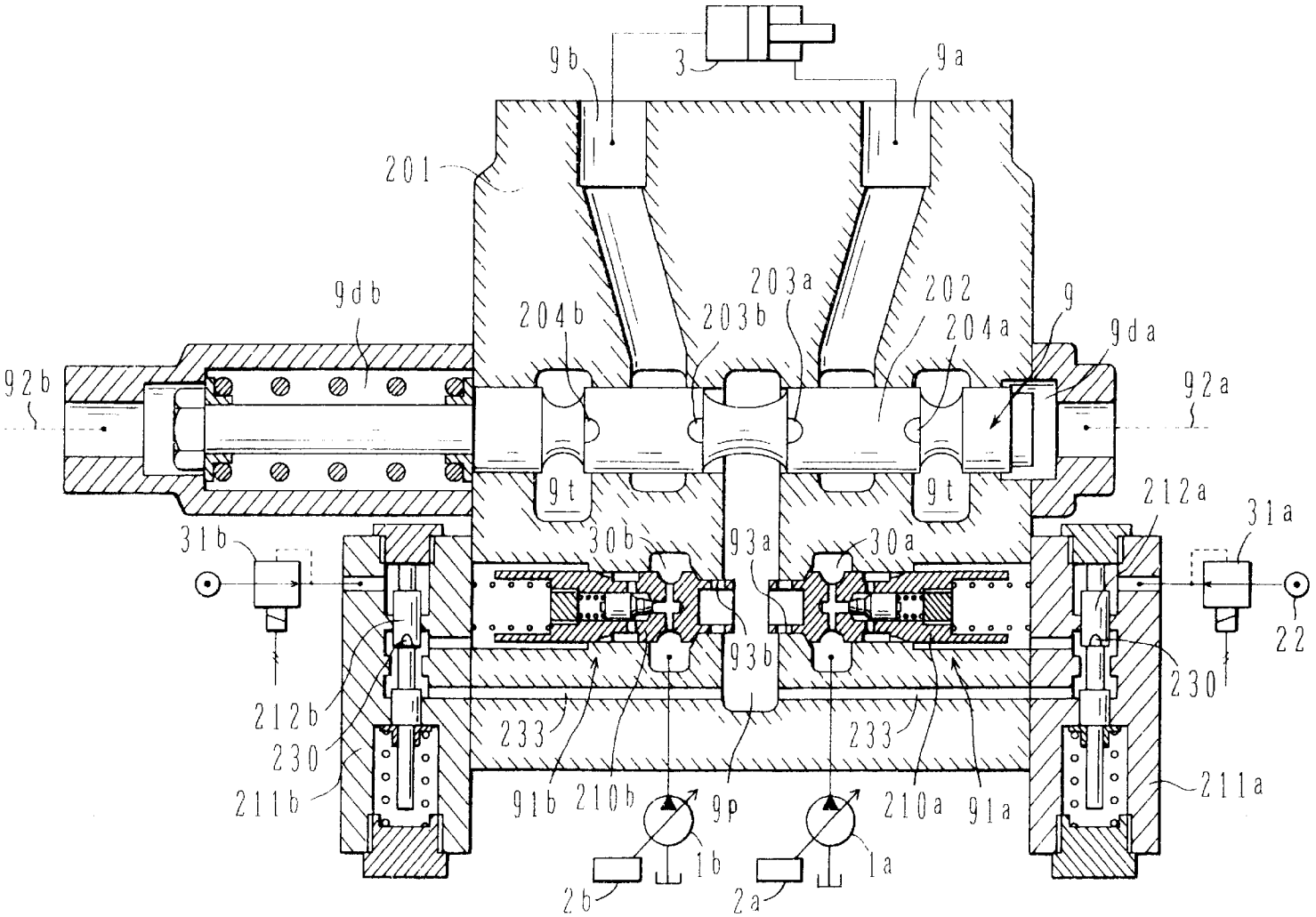
FIG. 24 is a sectional view taken along line XXIV—XXIV in FIG. 23.
Figure 25:
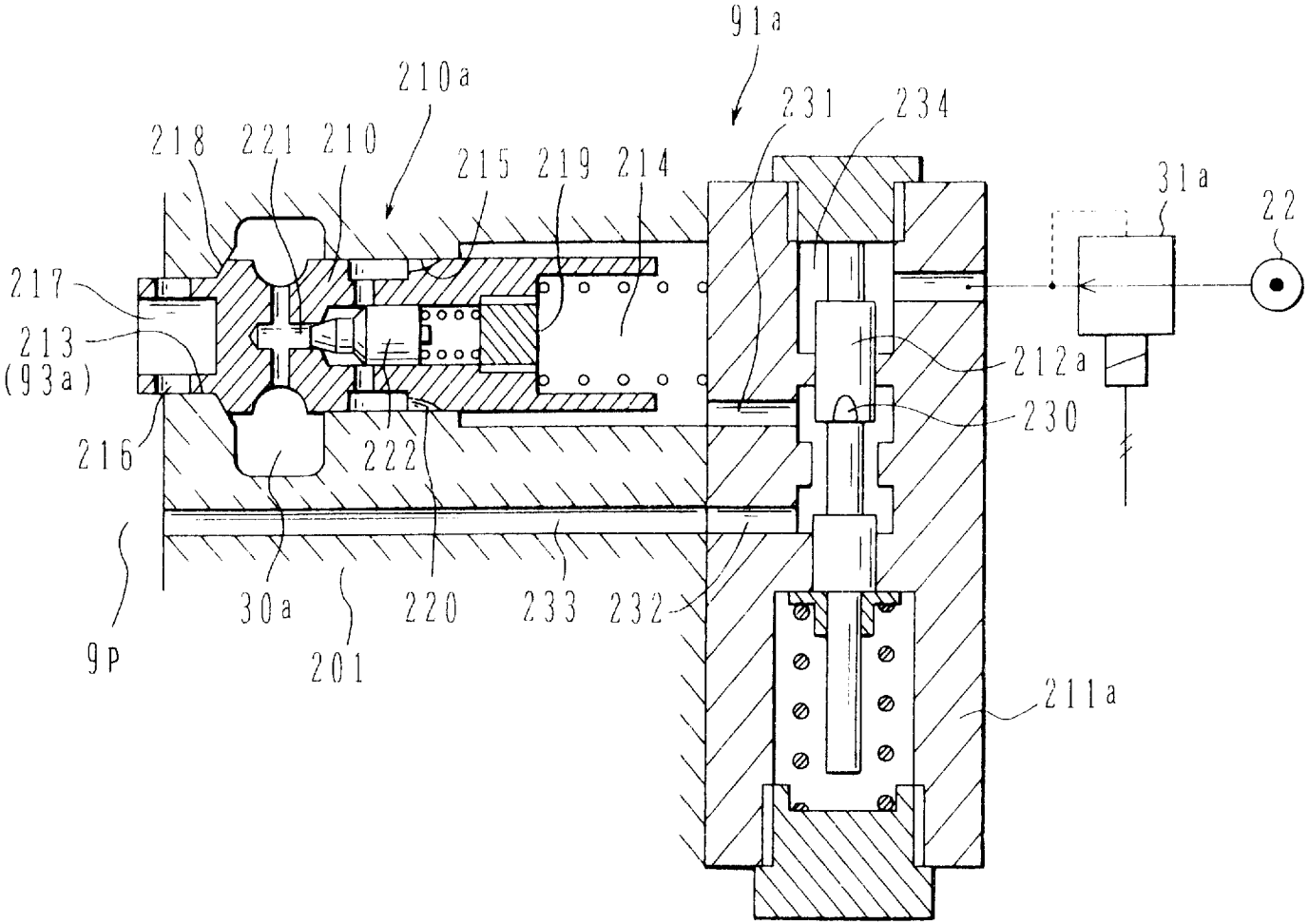
FIG. 25 is a partial enlarged view of FIG. 24.
Figure 26:
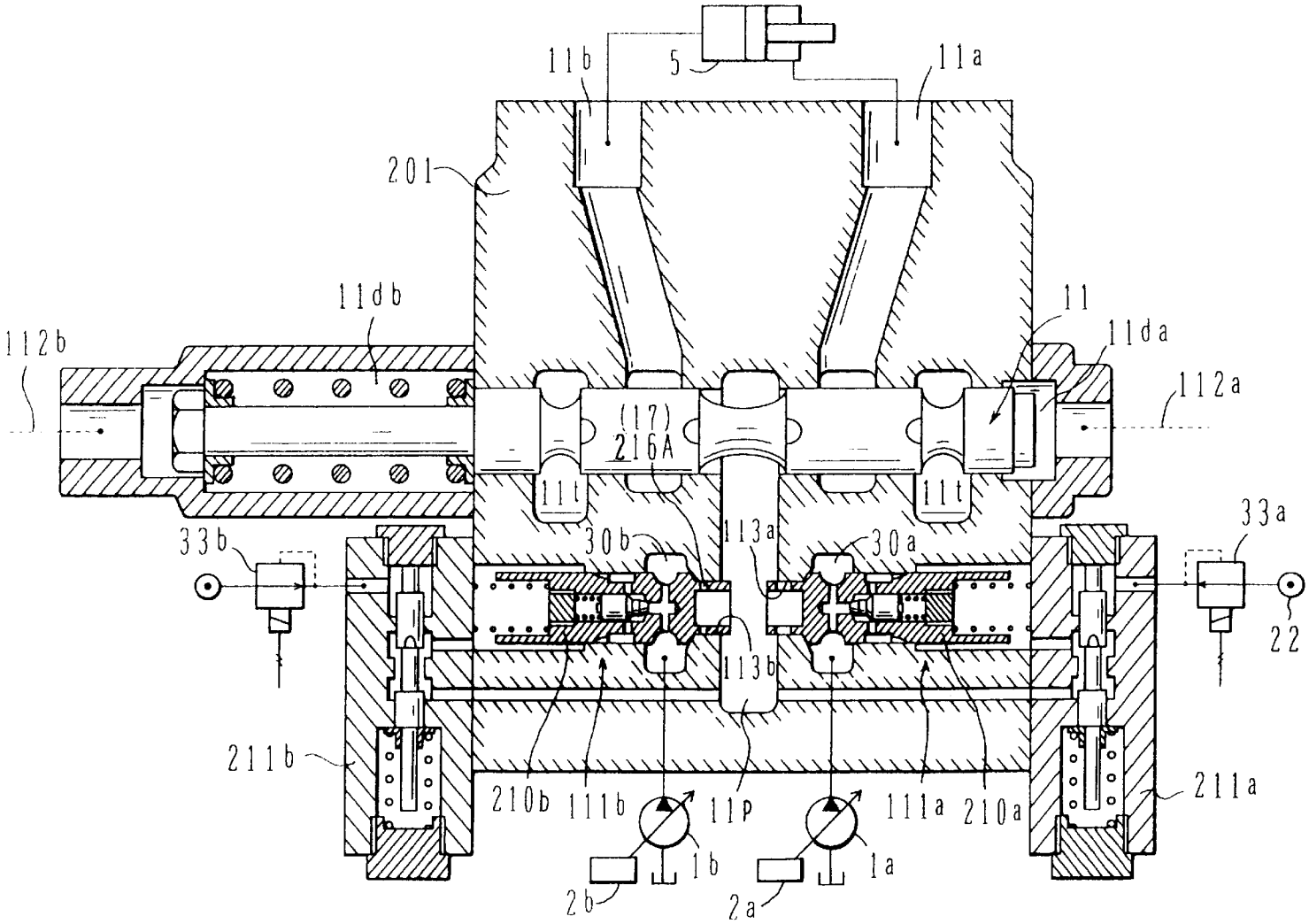
FIG. 26 is a sectional view taken along line XXVI—XXVI in FIG. 23.
Figure 27:
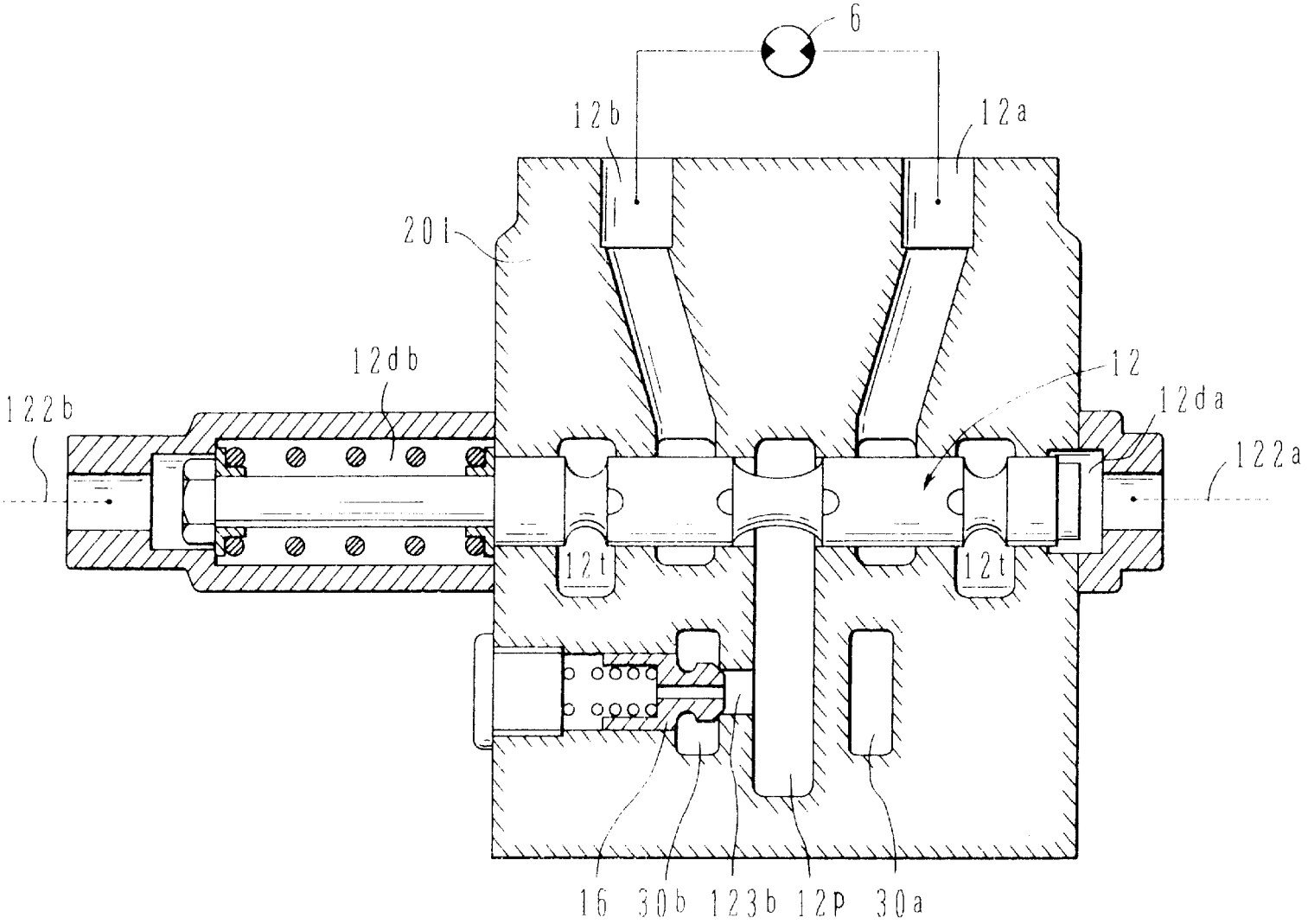
FIG. 27 is a sectional view taken along line XXVII—XXVII in FIG. 23.
Figure 28:
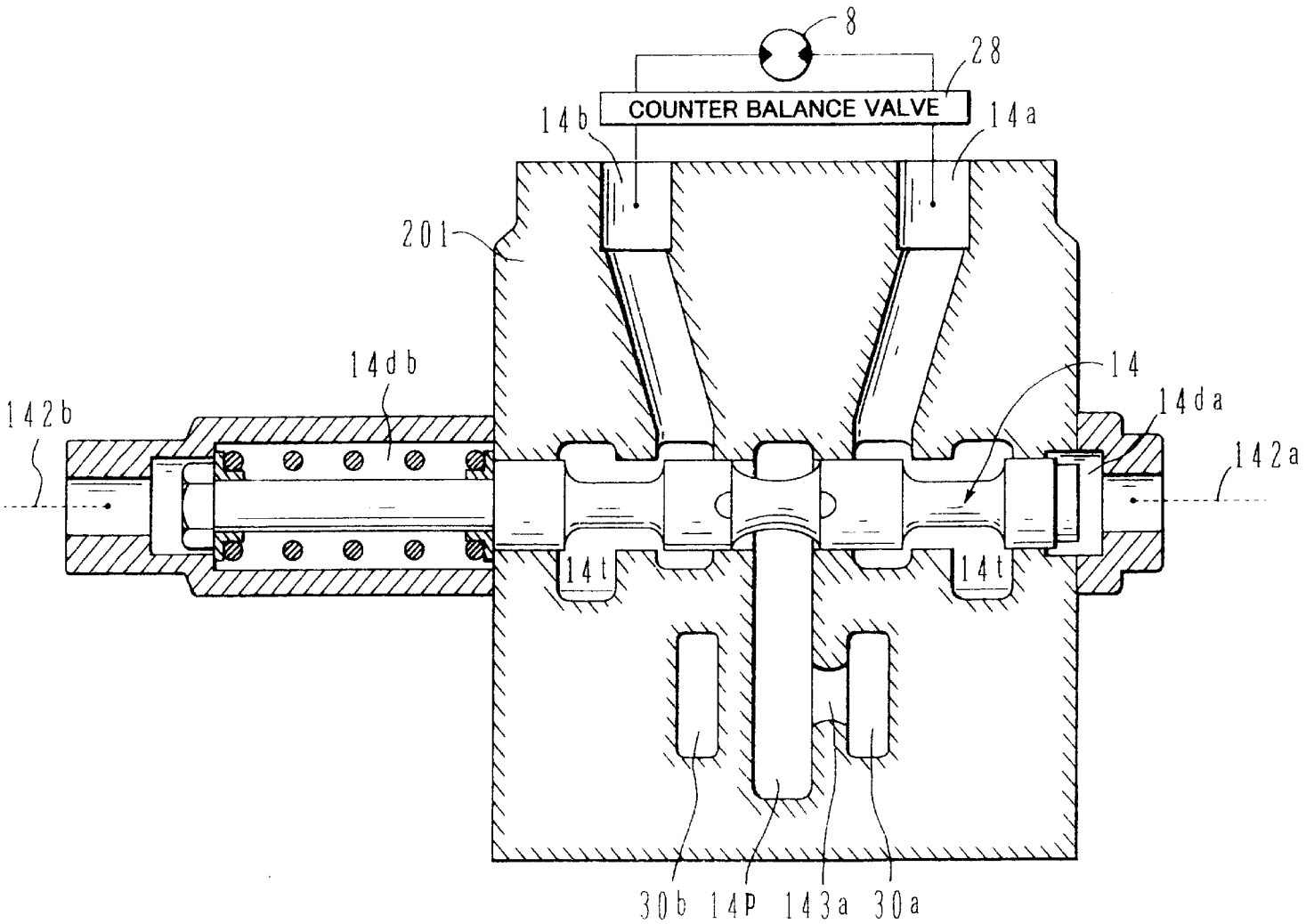
FIG. 28 is a sectional view taken along line XXVIII—XXVIII in FIG. 23.
Figure 29:
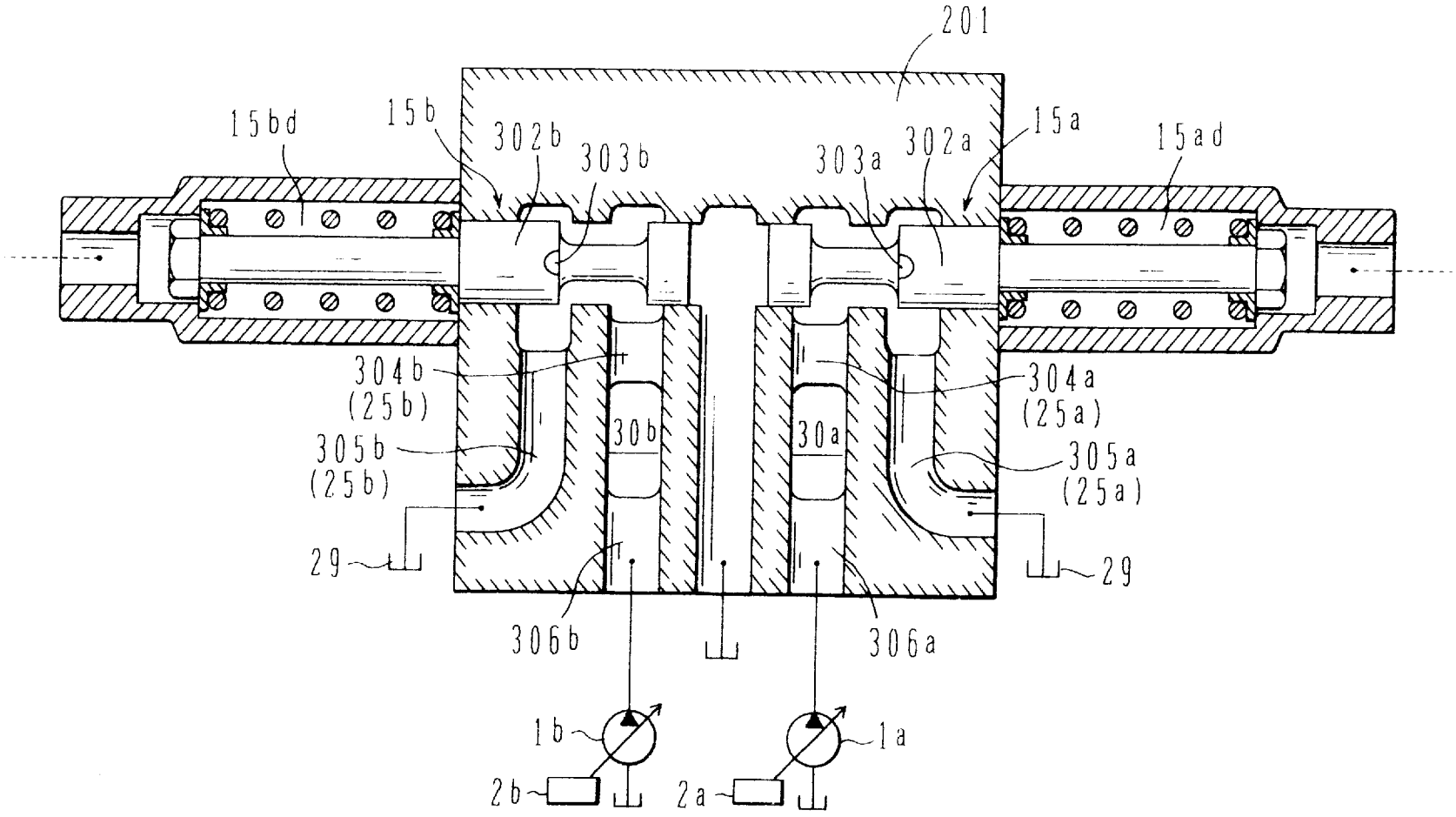
FIG. 29 is a sectional view taken along line XXIV—XXIV in FIG. 23.

FIG. 23 shows an appearance of the valve apparatus, FIG. 24 is a sectional view taken along line XXIV—XXIV in FIG. 23, including the boom directional control valve 9 and the auxiliary valves 91*a*, 91*b*, FIG. 25 is an enlarged view of a portion including the auxiliary valve, FIG. 26 is a sectional view taken along line XXVI—XXVI in FIG. 23, including the bucket directional control valve 11 and the auxiliary valves 111*a*, 111*b*, FIG. 27 is a sectional view taken along line XXVII—XXVII in FIG. 23 including the swing directional control valve 12, FIG. 28 is a sectional view taken along line XXVIII—XXVIII in FIG. 23 including the travel motor directional control valve 14, and FIG. 29 is a sectional view taken along line XXIX—XXIX in FIG. 23, including the bleed valves 15*a*, 15*b*.

In FIG. 23, denoted by 200 is the valve apparatus including the directional control valves 9–14, the auxiliary valves 91*a*, 91*b*; 101*a*, 101*b*; 111*a*, 111*b*; 131*a*, 131*b*, and the bleed valves 15*a*, 15*b*. The valve apparatus 200 has a common housing 201 in which the first and second pump lines 30*a*, 30*b* are defined as shown in FIGS. 24 to 29.

As shown in FIG. 24, the boom directional control valve 9 has a spool 202 slidable in the housing 201, the spool 202 having notches 203*a*, 203*b*; 204*a*, 204*b* formed therein. Also, the housing 201 has formed therein the first and second boom feeder lines 93*a*, 93*b*, the pump port 9*p* of the boom directional control valve 9, the actuator ports 9*a*, 9*b*, and the reservoir port 9*t*. The notches 203*a*, 203*b* make up meter-in variable throttles for communicating the pump port 9*p* with the actuator ports 9*a*, 9*b*, and the notches 204*a*, 204*b* make up meter-out variable throttles for communicating the actuator ports 9*a*, 9*b* with the reservoir port 9*t*. The hydraulic driving sectors 9*da*, 9*db* are provided at opposite ends of the spool 202.

The auxiliary valves 91*a*, 91*b* of poppet type comprise respectively poppet valves 210*a*, 210*b* being slidable in the housing 201 to selectively open and close the feeder lines 93*a*, 93*b*, and pilot spools (pilot valves) 212*a*, 212*b* being slidable in blocks 211*a*, 211*b* fixed to the housing 210 and operating the poppet valves 210*a*, 210*b*.

As shown in FIG. 25 in an enlarged scale, the poppet valve 210*a* of the auxiliary valve 91*a* has a poppet 210 slidably inserted into a bore 213 defining the feeder line 93*a* and a bore 215 defining a back pressure chamber 214. In a portion of the poppet 210 which is inserted into the bore 213, there is formed an opening 216 for flow rate control which changes an opening area established between the pump line 30*a* and the pump port 9*p* depending on a stroke through which the poppet 210 is moved. The poppet 210 has a pressure bearing portion 217 for bearing the pressure at the pump port 9*p*, a pressure bearing portion 218 for bearing the pressure in the pump line 30*a*, and a pressure bearing portion 219 for bearing the pressure in the back pressure chamber 214. Assuming that the effective pressure bearing area of the pressure bearing portion 217 is Ap, the effective pressure bearing area of the pressure bearing portion 218 is Az, and the effective pressure bearing area of the pressure bearing portion 219 is Ac, the relationship of Ac=Az+Ap holds. Further, in a portion of the poppet 210 which is inserted into the bore 215, there is formed a feedback slit 220 which changes an opening area communicated with the back pressure chamber 214 depending on a stroke through which the poppet 210 is moved. Also, the poppet 210 has an inner passage 221 formed therein for communicating the feedback slit 220 with the pump port 30*a*, and a load check valve 222 for preventing a reverse flow from the load side is disposed in the inner passage 221.

The pilot spool 212*a* has a notch 230 formed therein, the notch 230 constituting a pilot variable throttle whose opening area is changed depending on a stroke through which the pilot spool 212*a* is moved. Also, a passage 231 for communicating the back pressure chamber 214 with a space including the notch 230 is formed in the block 211*a*, and passages 232, 233 for communicating the space including the notch 230 with the pump port 9*p* are formed in the block 211*a* and the housing 201, respectively. A pilot flow rate through a pilot line made up of the back pressure chamber 214, the feedback slit 220, the inner passage 221 and the passages 231, 232, 233 is varied by changing the opening area of the pilot variable throttle. On the side of one end of the pilot spool 212*a*, there is provided a hydraulic driving sector 234 to which a control pressure is introduced from the proportional solenoid valve 31*a*. The pilot spool 212*a* is moved by the hydraulic driving sector 234 in accordance with the control pressure.

The poppet valve 210*b* and the pilot spool 212*b* on the side of the auxiliary valve 91*b* are similarly constructed.

The principles of the auxiliary valve 91*a* of poppet type constructed as described above are known in the art. Assuming that the ratio of the effective pressure bearing area Ac of the pressure bearing portion 219 of the poppet 210 on the side of the back pressure chamber 214 to the effective pressure bearing area Ap of the pressure bearing portion 218 of the poppet 210 on the side of the pump line 30*a* (or 30*b*) is K, the pressure in the pump line 30*a* (or 30*b*) (i.e., the pump pressure) is Pp, and the pressure at the pump port 9*p* (i.e., the pressure on the entry side of the meter-in variable throttle) is Pz, the pressure Pc in the back pressure chamber 214 is expressed by a function of K, Pp and Pz. Thus, the poppet 210 is moved so that the opening area established by the feedback slit 220 is held in a predetermined relationship depending on K with respect to the opening area established by the notch 230 of the pilot spool 212*a* (or 212*b*). Given Ac:Ap=2:1 and K ½, by way of example, Pc=(Pp+Pz)/2 results and the poppet 210 is moved so that the opening area established by the feedback slit 220 is equal to the opening area established by the notch 230 of the pilot spool 212*a* (or 212*b*). At this time, by properly selecting the size of the opening 216, the opening area communicated from the pump line 30*a* (or 30*b*) to the pump port 9*p* can be optionally controlled by moving the pilot spool 212*a* (or 212*b*). Since the pilot spool 212*a* (or 212*b*) is controlled by the proportional solenoid valve 31*a* (or 31*b*), the opening area communicated from the pump line 30*a* (or 30*b*) to the pump port 9*p* can be eventually controlled by the controller 23 (variable resisting function).

Further, when the pump port 9*p* is subjected to a higher pressure load than the pump line 30*a* (or 30*b*), the load pressure is exerted on the pressure bearing portion 217 of the poppet 210 on the side of the pump port 9*p* and, simultaneously, the same pressure acts on the pressure bearing portion 219 of the poppet 210 on the side of the back pressure side 214 through the passages 233, 232, the notch 230 and the passage 231. Here, the pressure bearing portion 219 of the poppet 210 has a larger effective pressure bearing area than the pressure bearing portion 217 thereof. Therefore, the poppet 210 is pushed toward the pump port 9*p* and hence serves as a load check valve (reverse-flow preventing function).

Another set of the arm directional control valve 10 and the auxiliary valves 101*a*, 101*b* and still another set of the first travel directional control valve 13 and the auxiliary valves 131*a*, 131*b* are also constructed similarly to the above set of the boom directional control valve 9 and the auxiliary valves 91*a*, 91*b*.

The bucket directional control valve 11 and the auxiliary valves 111*a*, 111*b* are also constructed almost similarly to the boom directional control valve 9 and the auxiliary valves 91*a*, 91*b*. As shown in FIG. 26, however, the opening 216A for flow rate control defined in the poppet 210 of the auxiliary valve 91*b* is formed to have a small opening area so that it functions as the fixed throttle 17.

The swing directional control valve 12 and the second travel directional control valve 14 are also constructed, as shown in FIGS. 27 and 28, similarly to the boom directional control valve 9. In the swing directional control valve 12, however, the load check valve 16 is disposed in the feeder line 123*b* as shown in FIG. 27. The pump line 30*a* is not connected to the pump port 12*p*. In the second travel directional control valve 14, the feeder line 143*a* is merely a passage and the pump line 30*b* is not connected to the pump port 14*p*.

As shown in FIG. 29, the bleed valves 15*a*, 15*b* have spools 302*a*, 302*b* slidable in the housing 201, the spools 302*a*, 302*b* having notches 303*a*, 303*b* formed therein, respectively. Also, passages 304*a*, 305*a*; 304*b*, 305*b* serving as the first and second bleed lines 25*a*, 25*b* are formed in the housing 201. The notches 303*a*, 303*b* constitute bleed-off variable throttles for communicating the passages 304*a*, 304*b* with the passages 305*a*, 305*b*.

Further, the hydraulic driving sectors 15*ad*, 15*bd* are provided respectively at opposite outer ends of the spools 302*a*, 302*b*. Denoted by 306*a*, 306*b* are pump connection ports through which the first and second hydraulic pumps 1*a*, 1*b* are connected to the pump lines 30*a*, 30*b*.

By utilizing poppet valves as described above, the valve apparatus in which the auxiliary valves including the reverse-flow preventing function and the variable resisting function are built in can be easily realized without making the valve structure complicated.

Figure 30:
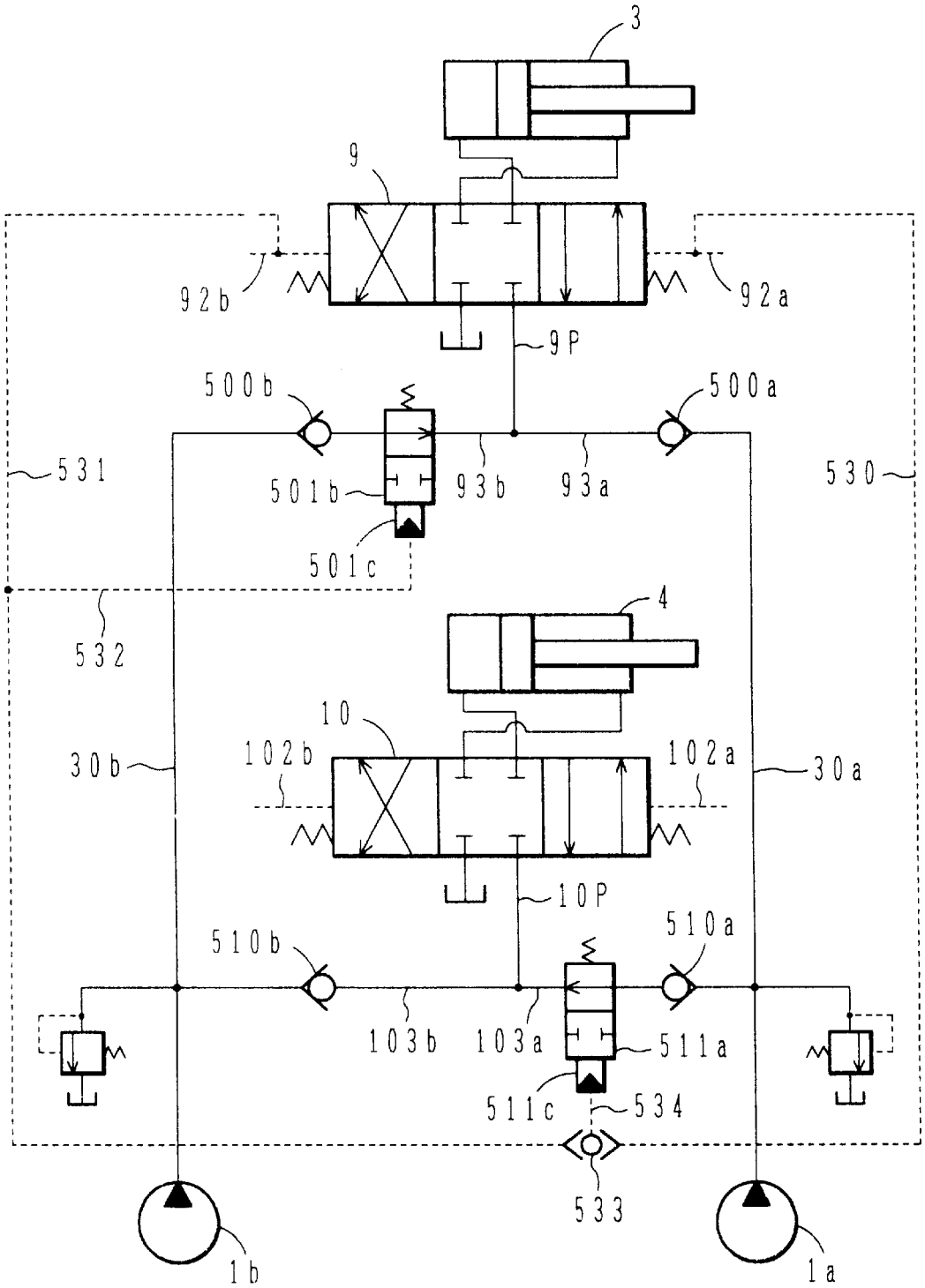
FIG. 30 is a circuit diagram of a hydraulic system according to a second embodiment of the present invention.

Another embodiment of the present invention will be described with reference to FIG. 30. In FIG. 30, equivalent members to those shown in FIG. 1 are denoted by the same reference numerals. In the foregoing embodiment, the auxiliary valve is constructed as a poppet type valve to have a function of a reverse-flow preventing valve as well, an electric command signal is output from the controller to the proportional solenoid valve, and the auxiliary valve is driven by the control pressure output from the proportional solenoid valve. By contrast, in this embodiment, a reverse-flow preventing valve and an auxiliary valve having a variable resisting function (including a flow cutoff function) are constituted as separate valves, and the auxiliary valve is directly driven by the pilot pressure signal from the control lever unit.

In FIG. 30, a check valve 500*a* is disposed in the first boom feeder line 93*a*, and a check valve 500*b* and an auxiliary valve 501*b* of spool type are disposed in the second boom feeder line 93*b*. The check valve 500*a* has a function as a reverse-flow preventing valve for preventing the hydraulic fluid from reversely flowing to the first hydraulic pump 1*a* from the feeder line 93*a*, the check valve 500*b* has a function as a reverse-flow preventing valve for preventing the hydraulic fluid from reversely flowing to the second hydraulic pump 1*b* from the feeder line 93*b*, and the auxiliary valve 501*b* has a flow cutoff function of selectively cutting off the flow of the hydraulic fluid supplied to the feeder line 93*b* from the second hydraulic pump 1*b*.

A check valve 510*a* and an auxiliary valve 511*a* of spool type are disposed in the first arm feeder line 103*a* and a check valve 510*b* is disposed in the second arm feeder line 103*b*. The check valve 510*a* has a function as a reverse-flow preventing valve for preventing the hydraulic fluid from reversely flowing to the first hydraulic pump 1*a* from the feeder line 103*a*, and the auxiliary valve 511*b* has a variable resisting function (including a flow cutoff function) of subsidiarily controlling the flow of the hydraulic fluid supplied to the feeder line 103*a* from the first hydraulic pump 1*a*. Also, the check valve 500*b* has a function as a reverse-flow preventing valve for preventing the hydraulic fluid from reversely flowing to the second hydraulic pump 1*b* from the feeder line 103*b*.

The auxiliary valve 501*b* and the auxiliary valve 511*a* are pilot-operated valves having respective hydraulic driving sectors 501*c*, 511*c* which operate in the direction to close the valves. The pilot pressure signal 92*b* in the boom-down direction is supplied to the hydraulic driving sector 501*c* through pilot lines 531, 532, and the pilot pressure signal 92*a* in the boom-up direction or the pilot pressure signal 92*b* in the boom-down direction is supplied to the hydraulic driving sector 511*c* through pilot lines 530, 531, a shuttle valve 53 and a pilot line 534.

During the sole operation of boom-up, the pilot pressure signal 92*b* is not output and the auxiliary valve 501*b* is held in a fully open position as shown. Therefore, the hydraulic fluids from the hydraulic pumps 1*a*, 1*b* are joined together after passing the check valves 500*a*, 500*b* and then sent to the directional control valve 9 and the boom cylinder 3 (joining circuit). During the sole operation of boom-down, since the pilot pressure signal 92*b* is output, the auxiliary valve 501*b* is operated to a fully closed position by the pilot pressure signal 92*b*, whereupon the hydraulic fluid from the hydraulic pump 1*a* is sent to the directional control valve 9 and the boom cylinder 3 through the check valve 500*a*.

During the simultaneous operation of the arm and boom-up, the auxiliary valve 501*b* is controlled to be fully opened and the auxiliary valve 511*a* is controlled to be throttled depending on the boom-up pilot pressure signal 92*a* (the operation amount of the boom directional control valve 9). Because a boom-up load pressure is high during the simultaneous operation of the arm and boom-up, the hydraulic fluid from the hydraulic pump 1*b* is primarily sent to the arm cylinder 4 through the check valve 510*b* and the directional control valve 10 (preference circuit). Most of the hydraulic fluid from the hydraulic pump 1*a* is sent to the boom cylinder 3 because the auxiliary valve 511*a* is throttled (preference circuit and adjustment of a preference degree).

During the simultaneous operation of the arm and boom-down, the auxiliary valve 501*b* is controlled to be fully closed by the boom-down pilot pressure signal 92*b* and the auxiliary valve 511*a* is controlled to be throttled depending on the boom-down pilot pressure signal 92*b* (the operation amount of the boom directional control valve 9). Because a boom-up load pressure is low during the simultaneous operation of the arm and boom-down, the hydraulic fluid from the hydraulic pump 1*b* is sent to the arm cylinder 4 by fully closing the auxiliary valve 501*b* (preference circuit). Most of the hydraulic fluid from the hydraulic pump 1*a* is sent to the boom cylinder 3 because the auxiliary valve 511*a* is throttled (adjustment of a preference degree).

As described above, with this embodiment wherein the auxiliary valve having a variable resisting function is constituted as a spool-type valve, the reverse-flow preventing valve and the auxiliary valve are constituted as separate valves, and the auxiliary valve is directly driven by the pilot pressure signal from the control lever unit, the joining circuit and the preference circuit can also be realized with a simple structure by employing a closed center circuit as with the first embodiment.

Still another embodiment of the present invention will be described with reference to FIGS. 31 to 33. In these drawings, equivalent members to those shown in FIGS. 1 and 3 are denoted by the same reference numerals. While in the foregoing embodiments the opening area of the auxiliary valve developing a variable resisting function is changed depending on only the operation amount of the directional control valve, it is changed depending on not only the operation amount of the directional control valve, but also the load pressure of the actuator in this embodiment.

Figure 31:
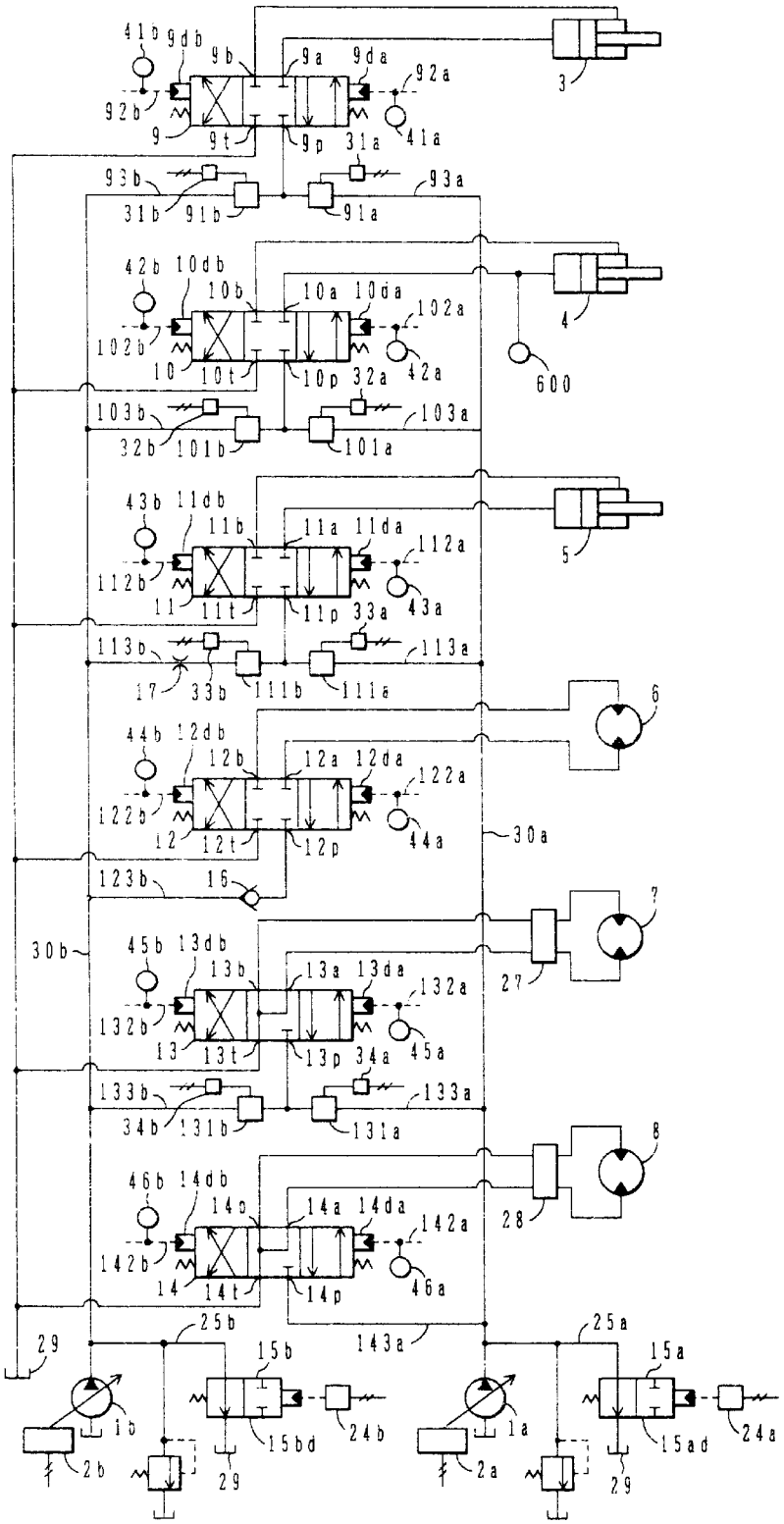
FIG. 31 is a circuit diagram of a hydraulic system according to a third embodiment of the present invention.
Figure 32:
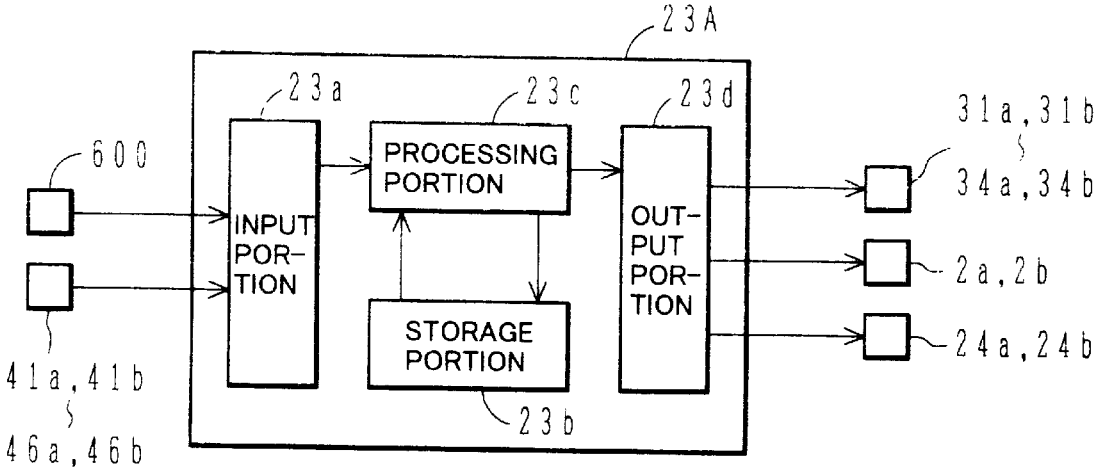
FIG. 32 is a block diagram of a controller of the hydraulic system shown in FIG. 31.

In FIG. 31, a load pressure sensor 600 for detecting a load pressure of the arm cylinder 4 in the extending direction (arm crowding direction) is disposed in an actuator line on the arm crowding side connected to the actuator port 10*a* of the arm directional control valve 10. In FIG. 32, a detection signal of the load pressure sensor 600 is also applied to the input portion 23*a* of a controller 23A in addition to the detection signals of the pilot pressure sensors 41*a*, 41*b*–46*a*, 46*b*. Also, when the simultaneous operation of boom-up and arm crowding is detected, the processing portion 23*c* of the controller 23A calculates a target opening area of the auxiliary valve 101*a* based on the detection signal of the boom-up pilot pressure sensor 41*a* and the detection signal of the load pressure sensor 600, and computes a command signal for the proportional solenoid valve 32*a* for the auxiliary valves 101*a*.

Figure 33:
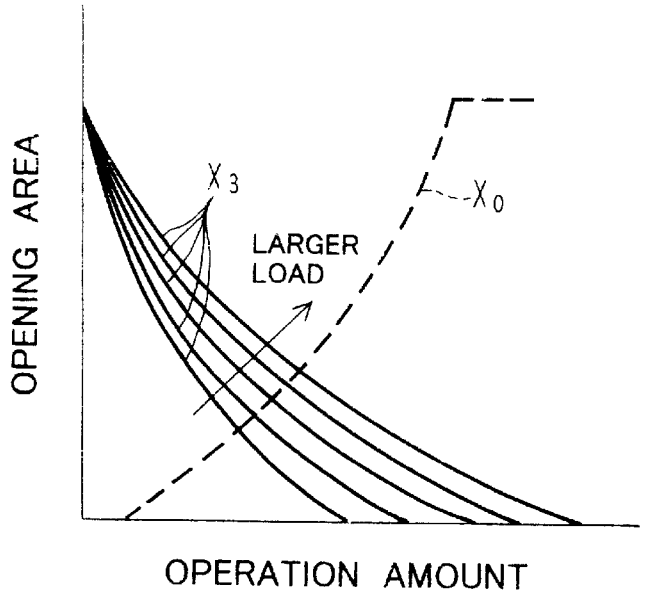
FIG. 33 is a graph showing opening curves of an auxiliary valve.

FIG. 33 shows the relationship among the operation amount of the boom directional control valve 9 (i.e., the pilot pressure signal) in the boom-up direction, the arm crowding load pressure, and the target opening area of the auxiliary valve 101*a*. As indicated by X3 in the graph of FIG. 33, the relationship is set such that as the operation amount of the boom directional control valve 9 in the boom-up direction increases, the opening area of the auxiliary valve 101*a* is changed from a maximum value in the fully open state to a minimum value in the fully closed state, and as the arm crowding load pressure increases, the opening area of the auxiliary valve 101*a* has a larger value at the same operation amount of the boom directional control valve 9 in the boom-up direction.

In this embodiment thus constructed, during the simultaneous operation of boom-up and arm crowding, the auxiliary valves 91*a*, 91*b*, 101*b* are controlled to be fully opened as mentioned above. Also, the auxiliary valve 101*a* is controlled to be throttled depending on the operation amount of the boom directional control valve 9 (FIG. 20), and to have a larger opening area as the arm-crowding load pressure increases (FIG. 33). Because the boom-up load pressure is high during the simultaneous operation of boom-up and arm crowding, the hydraulic fluids are supplied basically in a like manner to the above. Thus, the hydraulic fluid from the hydraulic pump 1*b* is primarily sent to the arm cylinder 4 through the auxiliary valve 101*b* and the directional control valve 10 and most of the hydraulic fluid from the hydraulic pump 1*a* is sent to the boom cylinder 3 because the auxiliary valve 101*a* is throttled. Further, since the arm-crowding load pressure varies to a large extent depending on an arm angle, the opening area of the auxiliary valve 101*a* is set to have a smaller value at the same valve operation amount in the boom-up direction when the arm-crowding load pressure is low and the difference between the arm-crowding load pressure and the boom-up load pressure is large, causing most of the hydraulic fluid from the hydraulic pump 1*a* to be sent to the boom cylinder 3 because the auxiliary valve 101*a* is throttled. On the other hand, the opening area of the auxiliary valve 101*a* is set to have a larger value at the same valve operation amount in the boom-up direction when the arm-crowding load pressure is increased and the difference between the arm-crowding load pressure and the boom-up load pressure becomes small, causing most of the hydraulic fluid from the hydraulic pump 1*a* to be sent to the boom cylinder 3 under a combination of throttling of the auxiliary valve 101*a* and the arm-crowding load pressure. Therefore, when part of the hydraulic fluid from the hydraulic pump 1*a* is supplied to the arm cylinder 4 through the auxiliary valve 101*a*, the extent by which the flow is throttled by the auxiliary valve 101*a* is small (i.e., the auxiliary valve 101*a* has a large opening area). As a result, the throttling loss produced when the hydraulic fluid passes auxiliary valve 101*a* is reduced and hence the energy loss is reduced.

With this embodiment, as described above, a hydraulic system having a structure capable of reducing the energy loss and saving energy, in addition to the advantages of the first embodiment, can be provided.

Industrial Applicability

According to the present invention, a joining circuit and a preference circuit can be realized in a closed center circuit with a simple structure.

Also, it is possible in a closed center circuit to set a preference degree and metering characteristics independently of each other during the combined operation of plural actuators, and to improve the operability in the combined operation.

We claim:

1. A hydraulic system comprising first and second hydraulic pumps, first and second actuators, a first directional control valve of closed center type connected to said first and second hydraulic pumps for controlling a flow rate of a hydraulic fluid supplied to said first actuator, and a second directional control valve of closed center type connected to at least said first hydraulic pump for controlling a flow rate of a hydraulic fluid supplied to said second actuator, wherein said hydraulic system further comprises:

first and second feeder lines respectively connecting said first and second hydraulic pumps to a pump port of said first directional control valve; and first and second reverse-flow preventing valves disposed respectively in said first and second feeder lines for preventing the hydraulic fluids from reversely flowing to said first and second hydraulic pumps;

wherein a first auxiliary valve with a flow cutoff function of selectively cutting off a flow of the hydraulic fluid supplied from said first hydraulic pump is disposed, in addition to said first reverse-flow preventing valve, in at least said first feeder line of said first and second feeder lines, said first auxiliary valve being operable in response to operation of said second directional control valve.

2. A hydraulic system comprising first and second hydraulic pumps, first and second actuators, a first directional control valve of closed center type connected to said first and second hydraulic pumps for controlling a flow rate of a hydraulic fluid supplied to said first actuator, and a second directional control valve of closed center type connected to at least said first hydraulic pump for controlling a flow rate of a hydraulic fluid supplied to said second actuator, wherein said hydraulic system further comprises:

first and second feeder lines respectively connecting said first and second hydraulic pumps to a pump port of said first directional control valve; and first and second reverse-flow preventing valves disposed respectively in said first and second feeder lines for preventing the hydraulic fluids from reversely flowing to said first and second hydraulic pumps;

wherein said second directional control valve is connected to said first and second hydraulic pumps, and said hydraulic system further comprises:

third and fourth feeder lines respectively connecting said first and second hydraulic pumps to a pump port of said second directional control valve, and third and fourth reverse-flow preventing valves disposed respectively in said third and fourth feeder lines for preventing the hydraulic fluids from reversely flowing to said first and second hydraulic pumps, wherein a first auxiliary valve with a flow cutoff function of selectively cutting off a flow of the hydraulic fluid supplied from said first hydraulic pump is disposed, in addition to said first reverse-flow preventing valve, in at least said first feeder line of said first and second feeder lines, and a second auxiliary valve with a flow cutoff function of selectively cutting off a flow of the hydraulic fluid supplied from said second hydraulic pump is disposed, in addition to said fourth reverse-flow preventing valve, in at least said fourth feeder line of said third and fourth feeder lines.

3. A hydraulic system according to claim 2, wherein each of said first and second auxiliary valves has a variable resisting function including said flow cutoff function.

4. A hydraulic system according to claim 3, wherein the variable resisting function of said first auxiliary valve increases line resistance depending on an operation amount of said second directional control valve, and the variable resisting function of said second auxiliary valve increases line resistance depending on an operation amount of said first directional control valve.

5. A hydraulic system according to claim 4, wherein the variable resisting function of at least one of said first and second auxiliary valves changes line resistance depending on a load pressure of one of said first and second auxiliary valves.

6. A hydraulic system according to claim 3, further comprising first and second bleed valves disposed respectively between said first and second hydraulic pumps and a reservoir, and reducing opening areas thereof depending on operation amounts of said first and second directional control valves.

7. A hydraulic system according to claim 3, wherein a third auxiliary valve with a variable resisting function including a flow cutoff function is disposed, in addition to said second reverse-flow preventing valve, in said second feeder line as with said first feeder line, and a fourth auxiliary valve with a variable resisting function including a flow cutoff function is disposed, in addition to said third reverse-flow preventing valve, in said third feeder line as with said fourth feeder line.

8. A hydraulic system according to claim 7, wherein each of said first to fourth auxiliary valves is a single valve including a function as each of said first to fourth reverse-flow preventing valves.

9. A hydraulic system according to claim 8, wherein said first to fourth auxiliary are poppet type valves comprising respectively poppet valves disposed in said first to fourth feeder lines, and pilot valves for controlling said poppet valves.

10. A hydraulic system for a hydraulic excavator comprising first and second hydraulic pumps, a plurality of actuators including a boom cylinder, an arm cylinder, a bucket cylinder, a swing motor and first and second travel motors and a plurality of directional control valves of closed center type including a boom directional control valve an arm directional control valve, a bucket directional control valve, a swing directional control valve and first and second travel directional control valves for controlling respective flow rates of hydraulic fluids supplied to said boom cylinder, said arm cylinder, said bucket cylinder, said swing motor and said first and second travel motors, wherein said hydraulic system further comprises:

first and second feeder lines and third and fourth feeder lines respectively connecting said first and second hydraulic pumps to pump ports of at least two of said plurality of directional control valves of closed center type, first and second reverse-flow preventing valves disposed respectively in said first and second feeder lines for preventing the hydraulic fluids from reversely flowing to the respective first and second hydraulic pumps, and first and second auxiliary valves disposed respectively in said first and second feeder lines having variable resisting functions of subsidiarily controlling flows of the hydraulic fluids from the respective first and second hydraulic pumps, and third and fourth reverse-flow preventing disposed respectively in said third and fourth feeder lines for preventing the hydraulic fluids from reversely flowing to the respective first and second hydraulic pumps, and third and fourth auxiliary valves disposed respectively in said third and fourth feeder lines and having variable resisting functions of subsidiarily controlling flows of the hydraulic fluids supplied from the respective first and second hydraulic pumps.

11. A hydraulic system for a hydraulic excavator according to claim 10, wherein at least two of said plurality of directional control valves are said boom directional control valve and said arm directional control valve, said first and second feeder lines are first and second boom feeder lines, said third and fourth feeder lines are first and second arm feeder lines, said first and second reverse-flow preventing valves are first and second boom reverse-flow preventing valves, said first and second auxiliary valves are first and second boom auxiliary valves, said third and fourth reverse-flow preventing valves are first and second arm reverse-flow preventing valves, and said third and fourth auxiliary valves are first and second arm auxiliary valves.

12. A hydraulic system for a hydraulic excavator according to claim 11, further comprising control means for controlling said variable resisting function so as to throttle said first arm auxiliary valve when boom operating means for instructing said boom cylinder to be driven is operated.

13. A hydraulic system for a hydraulic excavator according to claim 11, further comprising:

first and second bucket feeder lines respectively connecting said first and second hydraulic pumps to a pump port of said bucket directional control valve, and first and second bucket reverse-flow preventing valves disposed respectively in said first and second bucket feeder lines for preventing the hydraulic fluids from reversely flowing to the respective first and second hydraulic pumps, and first and second bucket auxiliary valves disposed respectively in said first and second bucket feeder lines and having variable resisting functions of subsidiarily controlling flows of the hydraulic fluids supplied from the respective first and second hydraulic pumps.

14. A hydraulic system for a hydraulic excavator according to claim 13, further comprising control means for controlling said variable resisting function so as to throttle said first arm auxiliary valve when at least one of boom operating means and bucket operating means for respectively instructing said boom cylinder and said bucket cylinder to be driven is operated.

15. A hydraulic system for a hydraulic excavator according to claim 14, wherein said control means controls said variable resisting function when said boom operating means, said bucket operating means, and arm operating means for instructing said arm cylinder to be driven are operated, such that said first and second boom auxiliary valves are opened, said first bucket auxiliary valve is throttled, and said second bucket auxiliary valve is closed when said boom operating means instructs boom-up, and said first boom auxiliary valve and said second bucket auxiliary valve are closed when said boom operating means instructs boom-down.

16. A hydraulic system for a hydraulic excavator according to claim 11, further comprising:

first and second travel feeder lines respectively connecting said first and second hydraulic pumps to a pump port of said first travel directional control valve, a third travel feeder line connecting said first hydraulic pump to a pump port of said second travel directional control valve, and first and second reverse-flow preventing valves disposed respectively in said first and second travel feeder lines for preventing the hydraulic fluids from reversely flowing to the respective first and second hydraulic pumps, and first and second travel auxiliary valves disposed respectively in said first and second travel feeder lines and having variable resisting functions of subsidiarily controlling flows of the hydraulic fluids supplied from the respective first and second hydraulic pumps.

17. A hydraulic system for a hydraulic excavator according to claim 16, further comprising control means for controlling said variable resisting functions so as to close said first travel auxiliary valve and open said second travel auxiliary valve when only first-and-second travel operating means for instructing said first and second travel motors to be driven is operated.

18. A hydraulic system for a hydraulic excavator according to claim 16, further comprising control means for controlling said variable resisting functions such that said first travel auxiliary valve is opened and said second travel auxiliary valve is throttled when at least one of boom operating means and arm operating means for respectively instructing said boom cylinder and said arm cylinder to be driven is operated, and at least one of said first boom auxiliary valve and said first arm auxiliary valve is throttled when said second travel operating means is operated.

19. A hydraulic system for a hydraulic excavator according to claim 16, further comprising:

first and second bucket feeder lines respectively connecting said first and second hydraulic pumps to a pump port of said bucket directional control valve, first and second bucket reverse-flow preventing valves disposed respectively in said first and second bucket feeder lines for preventing the hydraulic fluids from reversely flowing to the respective first and second hydraulic pumps, and first and second bucket auxiliary valves disposed respectively in said first and second bucket feeder lines and having variable resisting functions of subsidiarily controlling flows of the hydraulic fluids supplied from the respective first and second hydraulic pumps, and control means for controlling said variable resisting functions such that said first travel auxiliary valve is closed and said second travel auxiliary valve is opened when only first-and-second travel operating means for instructing said first and second travel motors to be driven is operated, that said first travel auxiliary valve is opened and said second travel auxiliary valve is throttled when at least one of boom operating means, arm operating means, bucket operating means and swing operating means for respectively instructing said boom cylinder, said arm cylinder, said bucket cylinder and said swing motor to be driven is operated, and that at least one of said first boom auxiliary valve, said first arm auxiliary valve and said first bucket auxiliary valve is throttled when said second travel operating means is operated.

20. A hydraulic system for a hydraulic excavator according to claim 11, further comprising a swing feeder line connecting said second hydraulic pump to a pump port of said swing directional control valve.

21. A hydraulic system for a hydraulic excavator according to claim 20, further comprising control means for controlling said variable resisting function so as to throttle said arm auxiliary valve when swing operating means for instructing said swing motor to be driven is operated.

22. A hydraulic system for a hydraulic excavator according to claim 20, further comprising control means for controlling said variable resisting functions when said boom operating means for instructing said boom cylinder to be driven is operated, such that said first and second boom auxiliary are both opened when said boom operating means instructs boom-up, and said first boom auxiliary valve is opened and said second boom auxiliary valve is closed when said boom operating means instructs boom-down.

23. A hydraulic system for a hydraulic excavator according to claim 10, further comprising first and second bleed valves disposed respectively between said first and second hydraulic pumps and a reservoir, and reducing opening areas thereof depending on operation amounts of at least two directional control valves.

* * * * *